US008127852B2

(12) United States Patent
Judge et al.

(10) Patent No.: US 8,127,852 B2
(45) Date of Patent: Mar. 6, 2012

(54) INTERCHANGEABLE SUBSEA WELLHEAD DEVICES AND METHODS

(75) Inventors: Robert Arnold Judge, Houston, TX (US); Perrin Rodriguez, Cypress, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 84 days.

(21) Appl. No.: 12/415,308

(22) Filed: Mar. 31, 2009

(65) Prior Publication Data

US 2010/0155074 A1 Jun. 24, 2010

Related U.S. Application Data

(60) Provisional application No. 61/140,424, filed on Dec. 23, 2008.

(51) Int. Cl.
*E21B 33/038* (2006.01)

(52) U.S. Cl. ..... 166/341; 166/338; 166/344; 166/352; 166/85.1; 166/85.4

(58) Field of Classification Search ..... 166/352, 166/341, 338, 339, 344, 381, 383, 85.1, 85.4, 166/85.5, 351
See application file for complete search history.

(56) References Cited

U.S. PATENT DOCUMENTS 3,551,005 A * 12/1970 Brun ..... 285/10
4,167,215 A * 9/1979 Thorne ..... 166/341
4,171,922 A * 10/1979 Coulboy et al. ..... 405/169
4,635,728 A * 1/1987 Harrington ..... 166/341
4,878,783 A * 11/1989 Baugh ..... 405/169
5,794,701 A * 8/1998 Cunningham et al. ..... 166/341
5,971,077 A * 10/1999 Lilley ..... 166/368
6,089,321 A * 7/2000 Morrill ..... 166/341
6,106,026 A * 8/2000 Smith, III ..... 285/85
6,142,233 A * 11/2000 Wilkins ..... 166/339
6,227,300 B1 * 5/2001 Cunningham et al. ..... 166/339
6,644,410 B1 * 11/2003 Lindsey-Curran et al. ... 166/360
6,679,472 B2 * 1/2004 Baugh ..... 251/62
6,805,382 B2 * 10/2004 Jennings ..... 285/18
6,827,147 B2 * 12/2004 Dallas ..... 166/379
6,938,695 B2 * 9/2005 Williams ..... 166/341
7,172,447 B2 * 2/2007 Allensworth et al. ..... 439/271
7,216,714 B2 * 5/2007 Reynolds ..... 166/338
7,216,715 B2 * 5/2007 Reynolds ..... 166/339
7,222,674 B2 * 5/2007 Reynolds ..... 166/341
(Continued)

OTHER PUBLICATIONS

Radoil, Inc., "Vertical Hot Stab Assembly Drawings," Nov. 13, 2007, pp. 1-4.

*Primary Examiner* — Thomas Beach
*Assistant Examiner* — Matthew Buck
(74) *Attorney, Agent, or Firm* — Potomac Patent Group PLLC

(57) ABSTRACT

A method for connecting a lower marine riser package to a lower blowout preventer stack. The method includes lowering a frame of the lower marine riser package toward a frame of the lower blowout preventer stack such that a first half of a feed-thru component contacts a second half of the feed-thru component; floating at least one of the first half of the feed-thru component or the second half of the feed-thru component while the frame of the lower marine package is further lowered toward the frame of the lower blowout preventer stack; and engaging the first half of the feed-thru component to the second half of the feed-thru component after further lowering the lower marine riser package toward the lower blowout preventer stack.

20 Claims, 18 Drawing Sheets

U.S. PATENT DOCUMENTS

| | | | | |
|---|---|---|---|---|
| 7,490,673 | B2 * | 2/2009 | Bartlett | 166/368 |
| 7,690,433 | B2 * | 4/2010 | Reynolds | 166/338 |
| 7,726,405 | B2 * | 6/2010 | McMiles | 166/344 |
| 2005/0072573 | A1 * | 4/2005 | Smith, III | 166/341 |
| 2009/0255681 | A1 * | 10/2009 | Spencer | 166/341 |
| 2009/0294129 | A1 | 12/2009 | Judge et al. | |
| 2009/0294130 | A1 | 12/2009 | Rodriguez | |

* cited by examiner

INTERCHANGEABLE SUBSEA WELLHEAD DEVICES AND METHODS

RELATED APPLICATION

This application is related to, and claims priority from, U.S. Provisional Patent Application Ser. No. 61/140,424, filed on Dec. 23, 2008 entitled "Interchangeable Subsea Wellhead Devices And Methods" to Perrin Stacy Rodriguez, the entire disclosure of which is incorporated here by reference.

BACKGROUND

1. Field of the Disclosure

Embodiments disclosed herein relate generally to interchangeably connecting subsea assemblies. In particular, embodiments disclosed herein relate to methods for manufacturing and constructing interchangeable lower marine riser packages with interchangeable subsea blowout preventer packages.

2. Background Art

A subsea blowout preventer ("BOP") stack is used to seal a wellbore during drilling operations, both for safety and environmental reasons. As shown in FIG. 1, a lower blowout preventer stack ("lower BOP stack") 14 may be rigidly attached to a wellhead upon the sea floor 20, while a Lower Marine Riser Package ("LMRP") 24 is retrievably disposed upon a distal end of a marine riser 10, extending from a drill ship 12 or any other type of surface drilling platform or vessel. As such, the LMRP 24 may include a stinger 26 at its distal end configured to engage a receptacle 28 located on a proximal end of lower BOP stack 14.

In typical configurations, the lower BOP stack 14 may be rigidly affixed atop a subsea wellhead and may include (among other devices) a plurality of ram-type blowout preventers useful in controlling the well as it is drilled and completed. Similarly, the LMRP 24 may be disposed upon a distal end of a long flexible riser that provides a conduit through which drilling tools and fluids may be deployed to and retrieved from the subsea wellbore. Ordinarily, the LMRP 24 may include (among other things) one or more ram-type blowout preventers at its distal end and an annular blowout preventer at its upper end.

When desired, ram-type blowout preventers of the LMRP 24 and the lower BOP stack 14 may be closed and the LMRP 24 may be detached from the lower BOP stack 14 and retrieved to the surface, leaving the lower BOP stack 14 atop the wellhead. Thus, for example, it may be necessary to retrieve the LMRP 24 from the wellhead stack in times of inclement weather or when work on a particular wellhead is to be temporarily stopped. When work is to resume, the LMRP 24 may be guided back to and engaged with the lower BOP stack 14 so that the ram-type blowout preventers may be opened and operations continued.

The lower BOP stack 14 may include any number and variety of blowout preventers 16 to ensure pressure control of a well, as is well known in the art. In general, the lower BOP stack 14 may be configured to provide maximum pressure integrity, safety, and flexibility in the event of a well control incident. However, various electrical, mechanical, and hydraulic controls need to extend from the surface vessel 12 to the various devices of the LMRP 24 and lower BOP stack 14. In typical subsea blowout preventer installations, multiplex ("MUX") cables (electrical) or lines (hydraulic) transport control signals down to the LMRP 24 and lower BOP stack 14 devices so the specified tasks may be controlled from the surface. Once the control signals are received, subsea control valves are actuated and (in most cases) high-pressure hydraulic lines are directed to perform the specified tasks. Thus, a multiplexed electrical or hydraulic signal may operate a plurality of "low pressure" valves to actuate larger valves to communicate the high-pressure hydraulic lines with the various operating devices of the wellhead stack.

Therefore, several and varied feed-thru components are used to carry the various mechanical, electrical, and hydraulic signals (including working fluids) from the surface vessel 12 to the working devices of the LMRP 24 and to the lower BOP stack 14. For feed-thru components that are bridged between the LMRP 24 and the lower BOP stack 14, a first mating half of the component may be located upon a distal end of the LMRP 24 and a second mating half of the component may be located upon a proximal end of the lower BOP stack 14. The first mating half and the second mating half are part of the feed-thru component. Examples of communication lines bridged between LMRPs and lower BOP stacks through such feed-thru components include, but are not limited to, hydraulic choke lines, hydraulic kill lines, hydraulic multiplex control lines, electrical multiplex control lines, electrical power lines, hydraulic power lines, mechanical power lines, mechanical control lines, electrical control lines, and sensor lines. In certain embodiments, subsea wellhead stack feed-thru components include at least one MUX "pod" connection whereby a plurality of hydraulic control signals are grouped together and transmitted between the LMRP 14 and the lower BOP stack 24 in a single mono-block feed-thru component.

Because of the many feed-thru component connections (in one application, there may be over 50 connections between the LMRP 24 and the lower BOP stack 14) that may be present between the LMRP 24 and the lower BOP stack 14, the LMRP 24 and lower BOP stack 14 have historically been constructed as unique, custom fit and/or "paired" components, wherein each LMRP 24 is manufactured to correspond to a single lower BOP stack 14 and therefore only capable of engaging with and landing to that single lower BOP stack 14. Historically, LMRPs and lower BOP stacks have been assembled on land prior to final subsea alignment and the feed-thru components have been connected to ensure that after disassembly, the mating halves of all the feed-thru components will align properly when re-assembly takes place at the job site, e.g., undersea.

However, this dry pre-assembly performed in a ground facility is time consuming and costly as the equipment necessary for lifting the LMRP 24 (which might weight more than one million pounds) is expensive, highly specialized and the workforce involved is substantial. In addition, by having to first fit the LMRP 24 to the lower BOP stack 14 on land, it will occupy a large space of the ground facility of the manufacturer, will delay the production of more LMRPs and lower BOP stacks and will also delay the delivery of the equipment to the oil extraction operator. Therefore, because of the difficulty to precisely (and repeatably) lay out and assemble feed-thru components of LMRPs and lower BOP stacks, to date, no two LMRP/lower BOP stack combinations are interchangeable, i.e., a first LMRP that mates with a first BOP stack, when disconnected from the first BOP stack, will not fit to a second BOP stack, and the other way around.

Due to the large scale of these components and the difficulty in precisely assembling undersea the LMRPs and the lower BOP stacks, even if an oil operator orders, for example, five identical LMRPs and lower BOP stacks, according to existing methods and procedures, one LMRP will correctly fit only one lower BOP stack of the five lower BOP stacks and not the remaining lower BOP stacks as one lower BOP stack is dry fit to one LMRP due to time and construction constraints, as already explained.

Disadvantageously, the custom-fitting of the LMRP 24 and lower BOP stack 14 together increases the amount of time required for the manufacturing and assembly processes. Further, in the event that an LMRP 24 or a lower BOP stack 14 requires repair or replacement, both the LMRP 24 and the lower BOP stack 14 have to be retrieved and either repaired together or replaced with a new pair of LMRP 24 and lower BOP stack 14. Formerly, if an LMRP from one distinct assembly was to be mated with a lower BOP stack from another distinct assembly (even if the distinct assemblies are of the same type and design) both "mismatched" assemblies had to be taken to a manufacturing facility to be "fitted" together.

One reason for the dry fitting of the LMRP 24 and the lower BOP stack 14 is the plural feed-thru connections that need to match each other. The feed-thru connections typically include corresponding mating halves, i.e., a first half of the feed-thru may be attached to the LMRP 24 and the second half may be attached to the lower BOP stack 14. Therefore, precision and accuracy with respect to the location of mounting holes in the frames of the LMRP 24 and the BOP stack 14 become an issue because cutting a large hole in a frame of steel that may have a thickness between 10 to 30 cm is challenging. The mounting holes on the LMRP frame and the lower BOP stack frame for a particular component may need to be positioned within a selected tolerance (hundredths to thousands of a millimeter) to allow the halves of the component to be mated to properly align and engage upon final assembly.

However, in conventional systems, due to the size of the LMRP 24 and lower BOP stack 14, fabrication limitations of the corresponding mating halves may be such that when assembled, corresponding mating halves are misaligned. Equipment that may typically be used for such precise tolerance may be unable to accommodate the large frames of the LMRP 24 and lower BOP stack 14. In this regard, it is noted that a conventional LMRP or a lower BOP stack may weight as much as one million pounds or more each and may have sizes in the order of a few yards if not tens of yards. In addition, in use, the entire process of mating is taking place undersea, where it is difficult to dispatch an operator to supervise the mating.

One approach for facilitating the connection of the LMRP and the lower BOP stack is discussed next with regard to FIGS. 2 and 3. FIGS. 2 and 3 show a hot stab line connection that is currently in use. FIG. 2 shows a hot stab feed-thru component 30 having a first half 32 and a second half 34. The two halves 32 and 34 are shown disconnected in FIG. 2. The first half 32 is fixed to a frame 36 while the second half 34 may slide a distance 44 relative to frame 38. In other words, the second half 34 may move in a plane perpendicular to a longitudinal axis 45 of the hot stab 30. However, this move is limited by a hole 46 in which the second half 34 is placed. The first half 32 includes an extension 40 which may rotate by about one degree around the longitudinal axis 45 of the hot stab 30. Prior to engaging the first and second halves 32 and 34 as shown in FIG. 3, the frame 36 and frame 38 must be in a final position so that neither frame moves relative to the other. In this regard, it is noted that both FIGS. 2 and 3 show the frames 36 and 38 being separated by a same distance, i.e., not moving relative to each other while contacting first half 32 to the second half 34. Another prior condition for engaging the first and second halves 32 and 34 shown in FIGS. 2 and 3 is that external pressure from an accumulator should be available to the first half 32 so that extension 40 can be lowered towards the second half 34 as shown in FIG. 3. The extension 40 enters the space 42 shown in FIG. 2 for engaging the second half 34 under the action of the external pressure.

Thus, the hot stab 30 shown in FIGS. 2 and 3 requires, prior to engagement of the halves 32 and 34, that (I) frames 36 and 38 are fixed in a final position, and (II) external pressure is available to contact and engage the feed-thru components to achieve the hot stab connection. One disadvantage of this type of connection is the following. Suppose that the extension 40 is extended relative to the first frame 32 such that the extension 40 extends past the first frame 36 towards the second frame 38. Given the large weight of the LMRP 24 and the lower BOP stack 14, if a misalignment occurs between the halves 32 and 34 of the hot stab shown in FIGS. 2 and 3 and the misalignment cannot be corrected by the movement of the extension 40 or the movement of the second half 34, then the extension 40 might be crashed by the weight of the first frame 32. It is noted that a typical diameter of the extension 40 is one inch (2.54 millimeters). Thus, the extension 40 is not extended unless the first and second frames are in final position, i.e., the frames do not move one relative to another.

What is needed is a simplified procedure and/or assembly for connecting an LMRP 24 to a lower BOP stack 14 without the need of a dry pre-assembly and/or pressurized extensions.

SUMMARY OF THE DISCLOSURE

Embodiments disclosed herein may provide the advantage of manufacturing LMRP and lower BOP stack assemblies separately without the need for mate-up or custom fitment between the two assemblies prior to deploying them undersea. This in turn may allow for mass production of the assemblies, faster and easier replacement of a LMRP or lower BOP stack in the event that one becomes unusable due to damage, as well as reduced downtime for maintenance of the assemblies.

According to an exemplary embodiment, there is a method for connecting a lower marine riser package to a lower blowout preventer stack. The method includes lowering a frame of the lower marine riser package toward a frame of the lower blowout preventer stack such that a first half of a feed-thru component attached to the frame of the lower marine riser package contacts a second half of the feed-thru component attached to the frame of the lower blowout preventer stack; floating at least one of the first half of the feed-thru component or the second half of the feed-thru component while the frame of the lower marine package is further lowered toward a part of the frame of the lower blowout preventer stack, wherein floating comprises allowing the first half of the feed-thru component to move with respect to the frame of the lower marine riser package or allowing a part of the second half of the feed-thru component to move with respect to the frame of the lower blowout preventer stack; and after further lowering the lower marine riser package toward the lower blowout preventer stack, engaging the first half of the feed-thru component to the second half of the feed-thru component to create a communication link between the lower marine riser package and the lower blowout preventer stack.

According to still another exemplary embodiment, there is a lower marine riser package. The package includes a frame having a mating surface and a first half of a feed-thru component configured to mate with a second half of the feed-thru component, the first half being displaced in a hole of the frame. The mating surface of the frame is configured to be lowered toward a proximal end of a lower blowout preventer stack such that the first half of the feed-thru component contacts the second half of the feed-thru component, the second half being attached to a frame of the lower blowout preventer stack. The first half is configured to float as the frame of the lower marine riser package is lowered further toward the proximal end of the lower blowout preventer stack, wherein floating comprises allowing a part of the first half of the feed-thru component to move with respect to the frame of the lower marine riser package, and the first half is configured to connect, after further lowering the frame of the lower marine riser package toward the lower blowout preventer stack, to the second half of the feed-thru component to create a communication link between the lower marine riser package and the lower blowout preventer stack.

According to still another exemplary embodiment, there is a lower blowout preventer stack. The stack includes a frame having a mating surface and a first half of a feed-thru component configured to mate with a second half of the feed-thru component, the first half being displaced in a hole of the frame. The mating surface of the frame is fixed and the second half is lowered toward the first half such that the first half of the feed-thru component contacts the second half of the feed-thru component, the second half being attached to a frame of a lower marine riser package. The first half is configured to float as the frame of the lower marine riser package is lowered further toward the frame of the lower blowout preventer stack, wherein floating comprises allowing a part of the first half of the feed-thru component to move with respect to the frame of the lower blowout preventer stack, and the first half is configured to connect, after further lowering the frame of the lower marine riser package, to the second half of the feed-thru component to create a communication link between the lower marine riser package and the lower blowout preventer stack.

Other aspects and advantages of the invention will be apparent from the following description and the appended claims.

BRIEF DESCRIPTION OF DRAWINGS

Embodiments of the present disclosure are discussed with reference to the drawings. Specifically, features of the present disclosure will become more apparent from the following description in conjunction with the accompanying drawings.

DETAILED DESCRIPTION

In one aspect, embodiments disclosed herein relate to interchangeable subsea devices. In particular, embodiments disclosed herein related to interchangeable subsea wellhead stack assemblies. More particularly still, embodiments disclosed herein relate to lower marine riser packages and lower blowout preventer stack packages that may be interchangeably mated together with other similarly-constructed wellhead stack assemblies.

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of interchangeable lower marine riser packages and lower blowout preventer stacks. However, the embodiments to be discussed next are not limited to these systems, but may be applied to other system that require easy and safe replacement of connected components used during the drilling of oil wells or the production of oil from wells, such as, for example, a wellhead, a remotely operated vehicle (ROV) mount, a production package, a workover package, a completion package, a riser, and combinations thereof, to name a few.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

As used herein, the term "subsea wellhead stack" refers to an assembly located atop a subsea wellhead that is used to control wellbore fluids and deliver equipment downhole. As such, a subsea wellhead stack should be interpreted by those having ordinary skill as including both the LMRP at the end of a marine riser and the lower BOP stack positioned above a wellhead as described above. Furthermore, as used herein, the term "interchangeable" means that an LMRP may be connected to various lower BOP stacks and a lower BOP stack may be connected to various LMRPs, i.e., they may be connected undersea to each other without prior dry fitting. In one application, the LMRP and the lower BOP stack may be connected without having to first mate up or test-fit the LMRP to the lower BOP stack to make fitment adjustments. In other words, interchangeability is the ability of an LMRP to be able to mate and make-up with another lower BOP stack within the same design, or vice versa (i.e., a lower BOP stack to mate with another LMRP).

Figure 4:
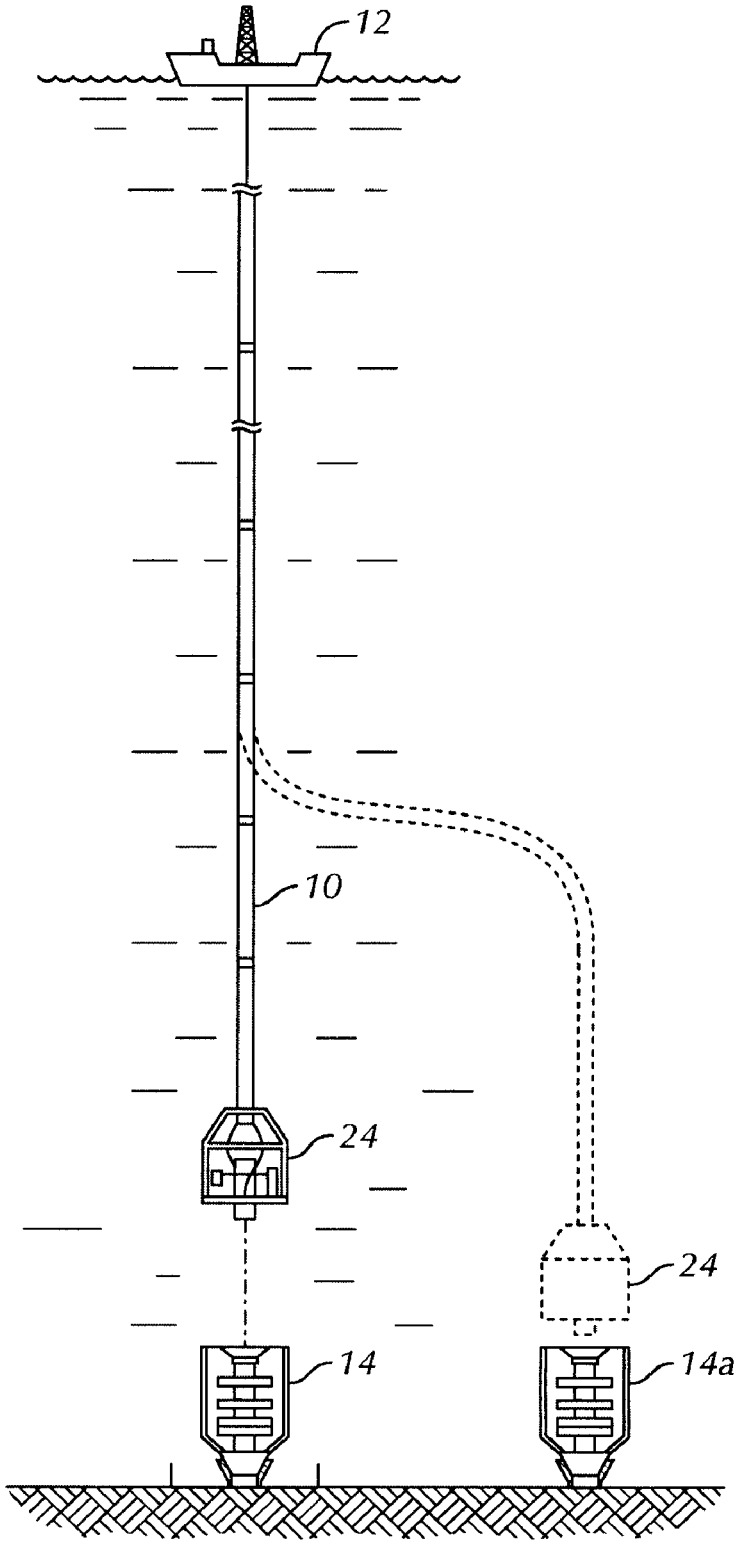
FIGS. 4 and 5 are schematic view drawings of LMRPs and lower BOP stacks in accordance with embodiments disclosed herein.
Figure 5:
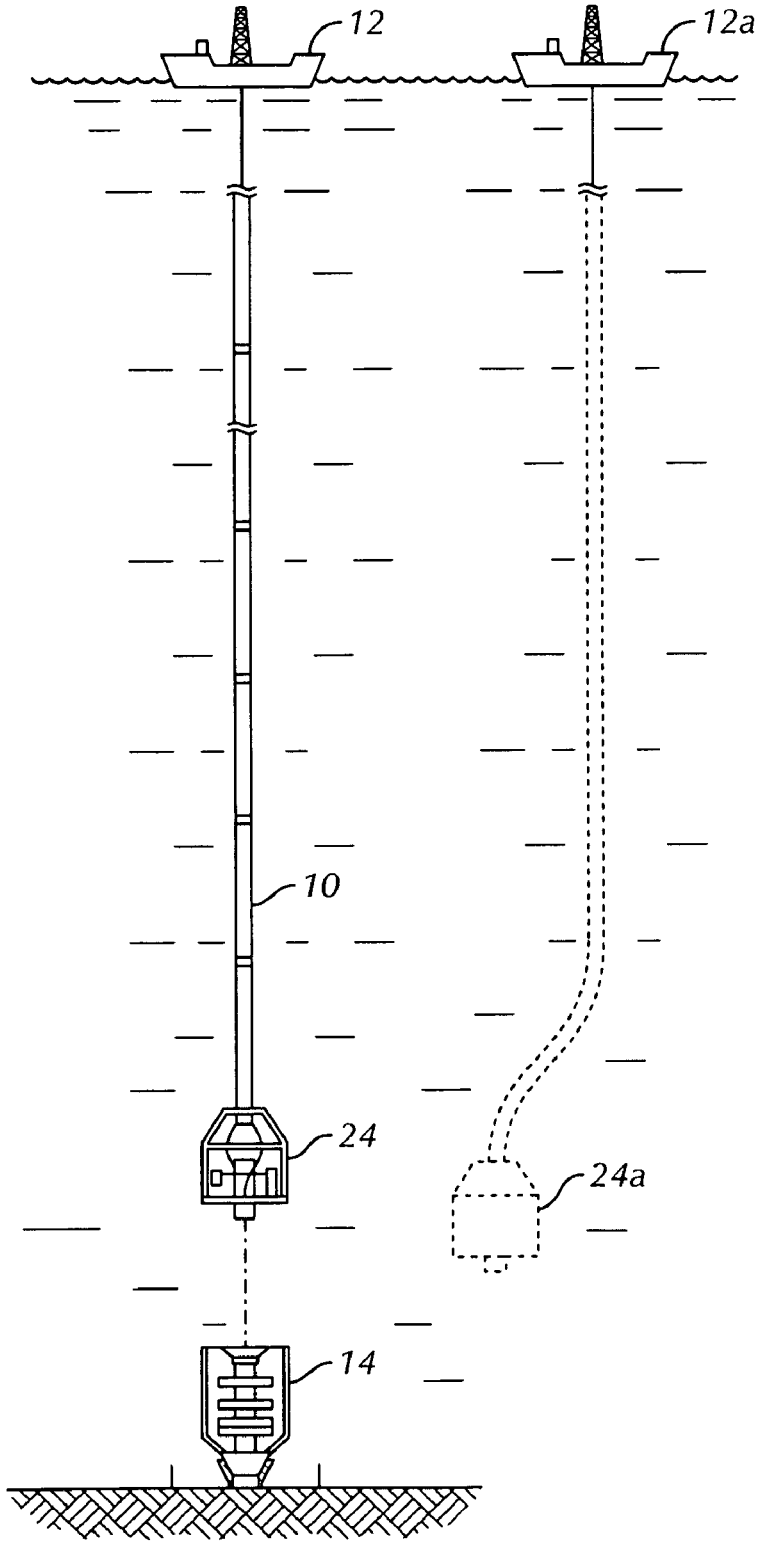

For example, referring to FIG. 4, if a production set includes a single LMRP 24 and two lower BOP stacks 14 and 14*a*, a single interchangeable LMRP 24 should be able to mate with either the first lower BOP stack 14 or the second lower BOP stack 14*a*. Similarly, referring to FIG. 5, if a production set includes a first LMRP 24 extending from a first vessel 12 (or a first platform) and a second LMRP 24*a* extending from a second vessel 12*a*, a single interchangeable lower BOP stack 14 should be able to mate with both LMRPs 24 and 24*a*.

Accordingly, interchangeability would allow for a drilling operator to maintain a "spare" inventory of components in the event that a replacement must be quickly found. Furthermore, in various subsea fields, a single drilling platform (e.g., a drillship) may need to service two distinct subsea wellheads. Formerly, if a drillship were to move from a first wellbore to a second wellbore, it was necessary to move the entire wellhead assembly (LMRP and lower BOP stack) together. However, if the novel interchangeability is implemented, the drillship may use the same LMRP for multiple lower BOP stacks. Furthermore, formerly, if a first vessel were to disconnect from a subsea wellhead so that a second vessel may connect to the subsea wellhead, it was necessary to remove both the LMRP and lower BOP stack. However, according to the exemplary embodiments to be discussed next this procedure is simplified as various vessels may connect with their LMRPs to the same lower BOP stack.

In order to manufacture such large and complex assemblies to be interchangeable, embodiments disclosed herein advantageously follow one or more of the following considerations: the use of oversized mounting holes such that the elements mounted on these oversized mounting holes may move along various directions and/or around various axes, fixing the mating halves of components within oversized holes relative to known datum axes such that the mating between corresponding halves is facilitated, the use of a precision measuring device to measure and verify the positions of the mating halves on the corresponding frames relative to the datum axes for the LMRP and the lower BOP stack, and the use of at least one floating feed-thru component such that a floating half of the component disposed either on a LMRP frame or a BOP stack frame is configured to move with respect to its corresponding mating half disposed on the other frame through a distance larger than existing manufacturing and/or assembling tolerances. One, some or all these features may be present in a wellhead assembly, as further described below.

As used herein, the term mating "half" refers to one piece of a multiple piece system that, once assembled, becomes a "component" of the system. Thus, every feed-thru component will comprise two mating halves, a first half (e.g. a male portion) and a second half (e.g., a female portion). Thus, a choke line feed-thru connector component may include a first half extending from a distal end of an LMRP and a second half extending from a proximal end of a lower BOP stack. However, in one application, a first half may include plural elements associated with various functions to be performed by the LMRP and lower BOP stack assembly and the second half may include corresponding plural mating elements. One such example is a MUX pod, which may include between 50 and 100 different functions and a corresponding number of connections. Furthermore, it should be understood by those having ordinary skill in the art that while the mating pieces of the components are referred to as "halves," no inference should be made that each half must necessarily contain 50% (or any other percentage) of the total feed-thru connector. Therefore, the choke line connector exemplified above may be constructed such that a majority of the components of the connector may be located either within the first mating half or in the second mating half.

Further, the locations of each mating half of the feed-thru components in their respective frames (either in the LMRP frame or in the lower BOP stack frame) may be established relative to one or more (preferably two or more) known fixed reference datums that help to precisely and repeatably position the feed-thru components and allow their corresponding mating halves to align and mate properly upon engagement of the LMRP with the lower BOP stack.

For example, reference datums may include an axis of the wellbore (a central or longitudinal axis that would extend through both LMRP and lower BOP stacks), an edge of a frame member, or a point repeatably identifiable upon a frame member. In certain embodiments, a Cartesian coordinate system may be used once a datum origin reference and an orientation datum reference have been established. As such, so that corresponding mating halves of components are positioned within a desired tolerance (e.g., within about ±0.4 mm (±0.015 in)), a fixed reference point in an x-direction and a corresponding fixed reference point in a y-direction may be selected from which to position corresponding mating halves of components in an X-Y plane.

Further still, to improve the accuracy in producing the layout of the components on their corresponding frame, a precision measuring system may be used. In other words, during the manufacturing/attachment of those parts of the LMRP 24 and the lower BOP stack 14 that form the feed-thru component or components to the frames, a same pattern may be used so that a first half of the feed-thru component that belongs to the LMRP 24 and a second half of the feed-thru component that belongs to the lower BOP stack 14 positionally match each other when the corresponding frames are mated. In one embodiment, multiple feed-thru components are disposed on each of the LMRP 24 and the lower BOP stack 14. For example, a choke line component, a kill line component, a hot line stab component and a multiplex POD component may be installed on the LMRP 24 and lower BOP stack 14. This means that first halves for each of these components are installed on a frame of the LMRP 24 and corresponding second halves for each of these components are installed on a frame of the lower BOP stack 14.

However, as discussed previously, because of the large sizes of the LMRP 24 and lower BOP stack 14, their large weights and the difficulty in using traditional manufacturing methods for precisely positioning the holes and/or the feed-thru components inside the holes such that the LMRP 24 fits the lower BOP stack 14, a conventional LMRP 24 and its corresponding lower BOP stack 14 are pre-assembled and adjusted while at the ground facility and then deployed under sea. This dry pre-assembly allows the operator to adjust the various elements of the feed-thru components such that the LMRP 24 fits the lower BOP stack 14. After the feed-thru components are adjusted during the dry pre-assembly, the LMRP 24 is disconnected from the lower BOP stack 14 and the LMRP 24 and the lower BOP stack 14 are provided to the oil operator.

To achieve the interchangeability of multiple LMRPs with multiple BOP stacks, and to eliminate the dry pre-assembly, according to an exemplary embodiment, frames of the LMRPs and BOP stacks are provided with holes in which the feed-thru components are disposed based on a same pattern and with a relative high accuracy by using, for example, a laser tracker system. In addition, those feed-thru components that are fixed to their frames are also aligned, within oversized holes, relative to predetermined reference datums. Thus, this consistent and accurate distribution of the holes and/or components in mating frames would ensure the mating of the LMRPs and the lower BOP stacks even if the LMRPs and the lower BOP stacks were not dry pre-assembled. Other features to be discussed later, for example, a floating feature, may improve the mating process.

In an embodiment disclosed herein, a laser tracker system, such as a Laser Tracker X commercially available from FARO of Lake Mary, Fla. may be used. Other systems for accurately placing the components and/or holes may be used. Laser tracking systems may be configured to measure large structures such as the large frames used for the stack assemblies. A master control unit ("MCU") may be positioned at a fixed location while a reflector or marker (e.g., a spherical ball with an "eye") may be moved to different locations on the frames to measure and record relative distances of mating halves of the feed-thru components with respect to either the MCU or another reference (origin) datum. The locations of the mating halves of the components may then be stored on a laptop as an electronic component pattern or blueprint or may be stored in any other data storage device for replication of a particular component layout at a later time.

Advantageously, the laser tracker system requires that only one fixed reference point be selected, from which relative positions in an x-direction and a y-direction may be selected. Those having ordinary skill in the art will appreciate that alternative two-dimensional coordinate systems (e.g., polar coordinates defined by a direction angle and a radial distance in a single plane) or three-dimensional coordinate systems (e.g., Cartesian coordinates defined by distances along X, Y, and Z directions and spherical or spherical polar coordinates defined by two angles and a radius) may be used without departing from the scope of the disclosure or the claimed subject matter. Furthermore, by using a data storage feature that may be included with the measurement system, a repeatable feed-thru component pattern may be accurately reproduced on plural LMRPs and lower BOP stacks. A consistent, reproducible component pattern may assist in performing a more accurate and reliable manufacturing process. Those having ordinary skill in the art will appreciate that other measuring devices (i.e., alternatives to laser tracking systems) may used to produce such a feed-thru component pattern without departing from the scope of the present disclosure or the claimed subject matter. For example, a radio-wave triangulation system (e.g., GPS) may be used to precisely and reproduceably locate feed-thru components and generate component patterns.

Figure 6:
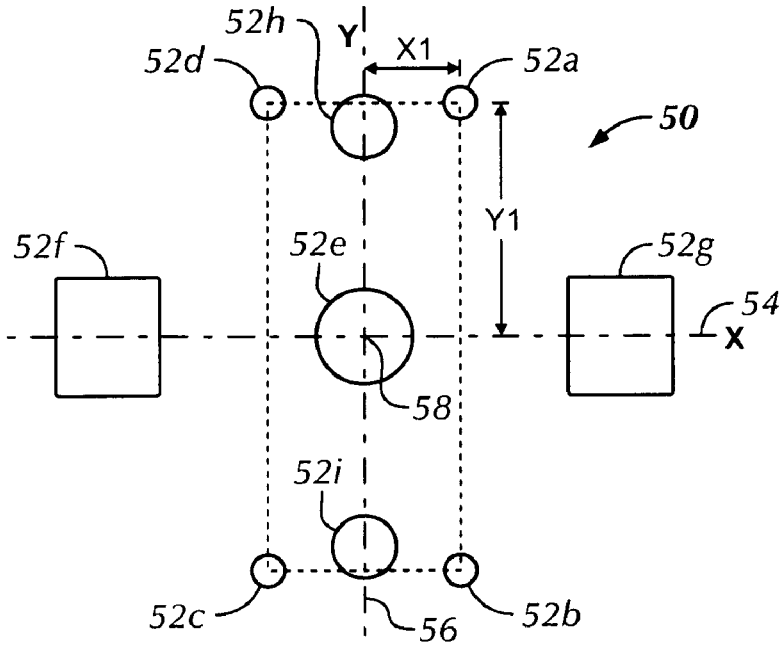
FIGS. 6 to 8 depict a feed-thru component pattern and a clocking process for the component pattern in accordance with embodiments of the present disclosure.

Referring to FIG. 6, a graphical representation of a component pattern 50 is shown. The component pattern 50 is exemplary of plural holes to be made in the frames of the LMRPs and the lower BOP stacks such that the LRMPs and the lower BOP stacks are interchangeable. While component pattern 50 is shown graphically as a printed (e.g., paper) document, one having ordinary skill will appreciate that such a pattern may be stored and manipulated entirely digitally (e.g., maintained electronically in a computer). As shown, all component locations 52*a-g* may be plotted out and identified, i.e., localized by at least two datum axes. In the present example, positions for components 52*a-g* may be identified with an X-axis 54, and a Y-axis 56 such than an origin 58 is located at the point (in the X-Y plane) where the X-axis 54 and the Y-axis 56 intersect. One of ordinary skill in the art would appreciate that a third Cartesian axis (e.g., a Z-axis not shown) may exist through origin 58 and extending in a direction normal to the plane (i.e., the X-Y plane) of the figure.

Therefore, for example, a center position of component 52*a* (i.e., a mating half of component 52*a*) may be stored as "X1" units away from Y-axis 56 in the X direction and "Y1" units away from X-axis 54 in the Y direction. With respect to components 52*a-g*, if each first mating half is precisely positioned within its hole upon an LMRP 24 using component pattern 50, and if each second mating half is precisely positioned within its hole upon a lower BOP stack 14 using the same component pattern 50, and the hole themselves are correctly (i.e., based on a same arrangement 50) positioned in the frames the ability to properly mate and make-up the LMRP 24 and the lower BOP stack 14 is facilitated.

According to an exemplary embodiment, the component pattern 50 may include positioning holes/recesses for plural feed-thru components. For example, hole 52*e* may correspond to a pin and hole component or guiding component, holes 52*h* and 52*i* may correspond to the choke and kill line components, hole 52*a* may correspond to a hot stab component, and holes 52*f* and 52*g* may correspond to the multiplex POD components. Those skilled in the art would understand that this distribution is only one of many other distributions possible for the components. Also, it is understood that the arrangement 50 shown in FIG. 6 may have more or less holes than those shown in the figure. The same arrangement 50 may be used on multiple LMRPs and BOP stacks for achieving the desired interchangeability of these subsea components.

Figure 7:
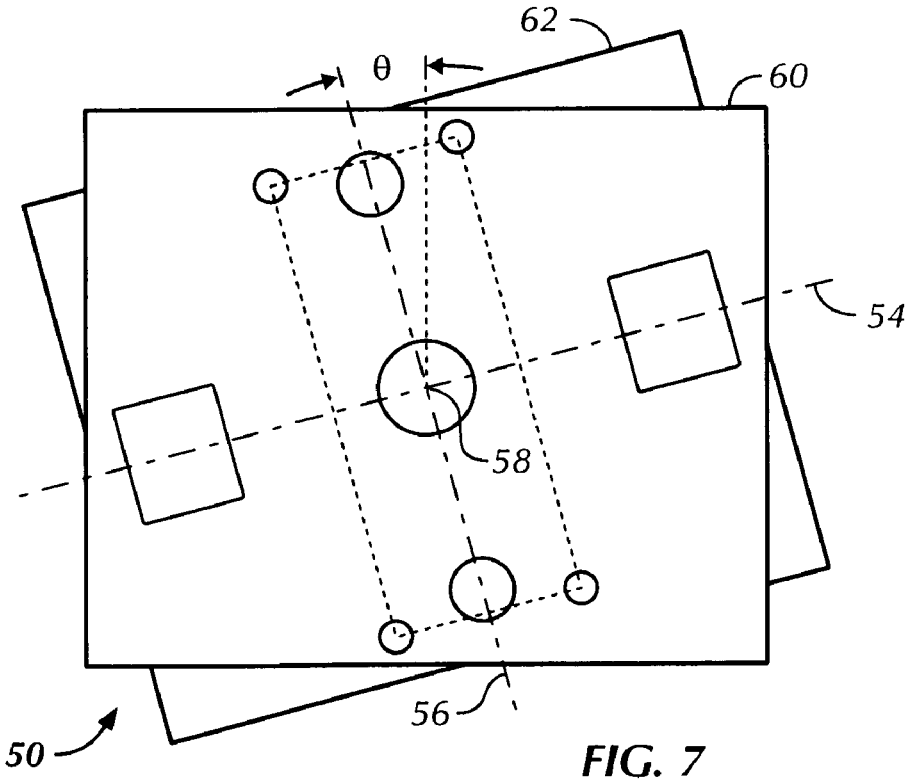

Once a "master" component pattern 50 is created, the layout may be applied to the actual frames of the LMRPs and the lower BOP stacks to position the mating halves of the components on the frames. However, as would be understood by those having ordinary skill in the art, the precise layout offered by component pattern 50 may not be sufficient alone to accurately locate the mating halves upon the LMRP and lower BOP stack frames. Referring now to FIG. 7, a skewed arrangement between an LMRP 60 and a lower BOP stack 62 is shown. While both the LMRP 60 and the lower BOP stack 62 include the applied component patterns 50, when lined up and engaged, the alignment of LMRP 60 with lower BOP stack 62 may be askew by an angle θ. Thus, further features, as discussed later, may be used to achieve the alignment of the corresponding patterns 50 of the LMRP 60 and BOP stack 62. However, the arrangement shown in FIG. 7 allows the LMRP 60 and the lower BOP stack 62 to correctly engage each other but this kind of skew alignment may have the disadvantage that requires more space for accommodating the non-conforming corners. Given that many subsea mechanisms for oil extraction have a limited space for the LMRP 60 and the lower BOP stack 62, it may be preferable to align the frame edges of the LMRP 60 and the lower BOP stack 62.

While many components extending between LMRP 60 and lower BOP stack 62 may function properly as so misaligned, according to an exemplary embodiment, other devices (e.g., mechanical alignment pins, mechanical locks, valve operators, etc.) may require a properly oriented alignment between LMRP 60 and lower BOP stack 62. For example, alignment guides may be constructed into the frame structures of LMRP 60 and lower BOP stack 62 themselves, such that if mating halves of components only align when such frames are skewed in relation to each other, such alignment guides may prevent (rather than facilitate) engagement of the LMRP 60 with the lower BOP stack 62.

Figure 8:
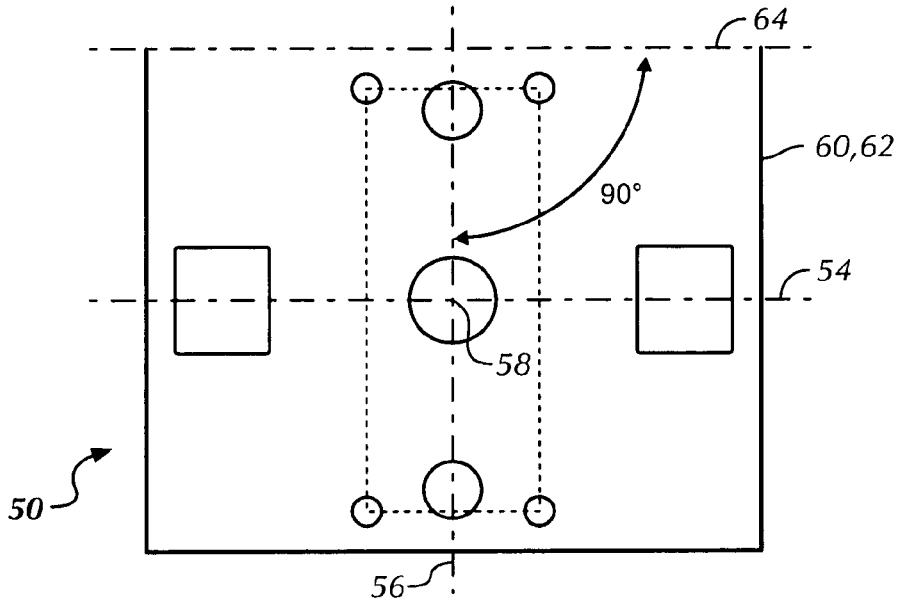

Therefore, in select embodiments of the present disclosure as shown in FIG. 8, the component pattern 50 may be "clocked" to each frame of the LMRP 60 and the lower BOP stack 62 so that the mating of the two frames is "square," i.e., an edge (i.e., a datum edge) 64 of each frame is aligned with X-axis 54 so that it may be orthogonal to Y-axis 56. Referring to FIG. 8, a properly clocked component pattern 50 is shown such that the frames of LMRP 60 and lower BOP stack 62 align squarely. Thus, during assembly of LMRP 60 and the lower BOP stack 62, a rotational alignment of the stack assemblies will allow the clocked component pattern 50 on both the LMRP 60 and the lower BOP stack 62 to squarely engage.

Furthermore, to aid in assembly and engagement of corresponding mating halves of components, additional adjustability (i.e., "play") may be designed into corresponding mating halves of feed-thru components. Certain embodiments disclosed herein provide increased adjustability of the corresponding mating components by using a combination of "over-sized" mounting holes on the frames and a "floating" configuration between corresponding mating halves of feed-thru components.

In addition or independently of the features discussed above, the plural feed-thru components may be designed and assembled such that they connect successively when the LMRP is mated with the lower BOP stack. In other words, assuming that there are four different feed-thru components (e.g., a choke line component, a kill line component, a hot line stab component, and a multiplex POD component), when the LMRP is brought in contact with the lower BOP stack, initially only the halves of the choke line component contact each other, without fully engaging each other. Thus, at this time the LMRP and the lower BOP stack are not fully functional as not all the connections have been established. As the LMRP is further lowered towards the lower BOP stack, the choke line component becomes fully engaged (not locked) while the halves of the kill line component contact each other without fully engaging each other and the process may continue for the remaining halves of the components. After all the halves have mated with each other, by further lowering the LMRP toward the lower BOP stack, the full engagement of the halves is achieved. The locking of the halves may be performed hydraulically, by applying an external pressure from an accumulator to a piston of the halves. Thus, according to this embodiment the floating of each pair of halves of a feed-thru component is achieved sequentially, such that the first one may have the largest amount of floating and the last one may have the least amount of floating.

According to another embodiment, the halves may float simultaneously or in sets, i.e., the halves of two feed-thru components are connected first followed by the halves of three feed-thru components, etc. According to still another exemplary embodiment, a pin and a receiving hole, disposed respectively on the LMRP and the lower BOP stack may be engaged first followed by the mating of the feed-thru components. According to yet another exemplary embodiment, plural pins and corresponding receiving holes may be used either prior to mating the feed-thru components or alternating, regularly or not, with the feed-thru components. In still another exemplary embodiment, no pins and receiving holes are used for mating the LMRP and the lower BOP stack.

Next the over-sized mounting holes and the floating features are discussed in more details. As would be understood by those having ordinary skill, over-sized mounting holes in the frames may allow a certain margin of error to be present when rigidly attaching mating halves of feed-thru components to the frames. While the positioning of the components on the frames may be performed with a specified degree of precision and accuracy (e.g., using the laser tracker system, clocking), the actual cutting of the frame mounting holes may be limited by manufacturing tolerances available at the time the LMRP and lower BOP stack assemblies are fabricated. In other words, cutting a hole through a frame that may be a solid slab of steel having, for example, a thickness of 10 to 30 cm, may not be accurately performed with the existing technology. Therefore, in the event that a mounting hole (as manufactured) is slightly off-center from its specified position, an over-sized mounting hole allows a component to be adjusted within the over-sized mounting hole to the position specified in the above-summarized layout. In other words, a mating half of the feed-thru component may be moved within an over-sized mounting hole until it is positioned correctly (as may be measured by the laser tracking system), at which point it may be fixed to the frame with welds, tightening of bolts, or the like.

In an exemplary embodiment, the oversized mounting holes may allow the components (more precisely the halves of the components) to be positioned within about ±0.4 mm (±0.015 in) of a specified (desired) location. To accommodate for a margin of error, in some embodiments the mounting holes may be over-sized by up to about 12.7 mm (0.5 in) radially or about 25.4 mm (1 in) diametrically. In one exemplary embodiment, the oversized holes are larger then regular holes by a predetermined amount, which may be one degree of magnitude larger than normal tolerances. In another exemplary embodiment, the normal tolerances may be in the range of hundredths to thousands of a millimeter while the predetermined amount may be in the order of tens of a millimeter or about a millimeter.

However, in other exemplary embodiments, the feed-thru components are not fixed to the frame but rather they are allowed to float in the oversized mounting hole. Thus, when a first half of a given feed-thru component mates with a second half of the given feed-thru component, one or both of the halves may move within the oversized mounting holes. In another embodiment, one half of the component is fixed to the frame while the other half is not. Therefore, the halves of the components may move (translate) within the oversized mounting holes and also they may rotate relative to the frame due to, for example, a bearing element to be discussed later.

Another advantageous aspect of the disclosed subject matter is a "floating" feature between corresponding mating halves of components that may be used. For the purpose of interchangeability, the term "float" is defined as the ability of at least one corresponding mating half of various components to move or float within a specified boundary, thus allowing for some slight "play" between corresponding mating halves of the components. For clarification and not to limit the exemplary embodiment, a first half of a feed-thru component may have a diameter smaller than a diameter of a second half of the feed-thru component such that the space (between the first half entering the second half) defined by the difference in these diameters is the specified boundary. In other words, the specified boundary in which a first mating half of a component may float may be defined by an inner surface of the corresponding second mating half of the component, or vice versa.

As used herein, floating may refer to a translational movement, a rotational movement, or a combination thereof (i.e., up to five degrees of freedom) between corresponding mating halves of components in any direction. Thus, the corresponding mating components may be allowed to translate and rotate by a specified amount. In one application, at least one half is allowed to float (move) relative to a corresponding frame to which the half is attached, as will be discussed later. In another application, both halves are allowed to float (move) relative to their frames. These movements may be allowed to be translations in a plane substantially perpendicular to a longitudinal axis of the well and/or rotations of one half relative to a contact point between the two halves.

In certain embodiments, a mating half of a component (e.g., a choke line connector, a kill line connector, a hot line stab, a multiplex POD connector, etc.) may be allowed to translate off a target centerline in three directions (i.e., in X, Y, and Z axes) and/or allowed to rotate about the X, Y, and Z axes. One skilled in the art will understand that the amount that the components are allowed to float may vary without departing from the scope of the present embodiments. However, the float (i.e., the amount of float) is larger than typical tolerances such that there is no confusion between "floating" an element and inherent tolerances associated with that element. By allowing at least one mating half of a component to float, proper alignment and engagement of the corresponding mating halves of the components during assembly of subsea stack assemblies may be achieved even after the mating halves have been rigidly affixed to their corresponding LMRP and/or lower BOP stack frames. Further, to facilitate the make-up of mating halves of a component, at least one of the mating halves may be provided with an alignment feature (e.g., an alignment "cone" in conjunction with a stab) to ensure that even at large amounts of "float", the mating halves may successfully make-up nonetheless.

As discussed above, proper engagement of the corresponding mating components of the BOP assembly is desirable to provide functionality of the BOP system and allow communication between the LMRP and the lower BOP stack. The communication is achieved by forming a communication link between the LMRP and the lower BOP stack. For example, if the considered functionality is providing electric power from the LMRP to the lower BOP stack, the communication link may be the connection of two different electric cables together, where a first electric cable is mounted with one end on the rig or ship and the second end on the LMRP and a second electric cable is mounted on the lower BOP stack. Electrically connecting the first and second cables by mating the LMRP and the lower BOP stack is considered to form the communication link. Similarly, for the choke line for example, by connecting a first pipe on the LMRP and a second pipe on the lower BOP stack such that a liquid under pressure flows through the first and second pipes constitute the communication link. The mating components may be used to carry out other functions of the blowout preventer, such as control or manipulation of various valves in the blowout preventer assembly during operation. Further, proper engagement between the mating components may prevent damage to the components during engagement. As previously mentioned, mating components may include choke and kill lines, hydraulic BOP operating fluid stabs, and a MUX pod wedge block/receiver system.

Figure 10:
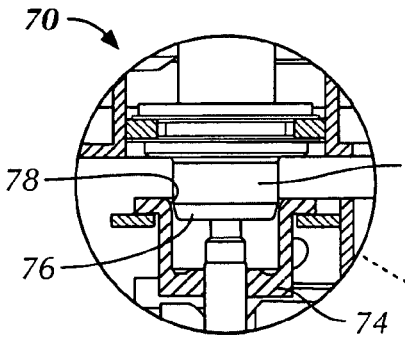
FIG. 10 shows a cross-sectional view of the choke and/or kill feed-thru component of FIG. 9.
Figure 9:
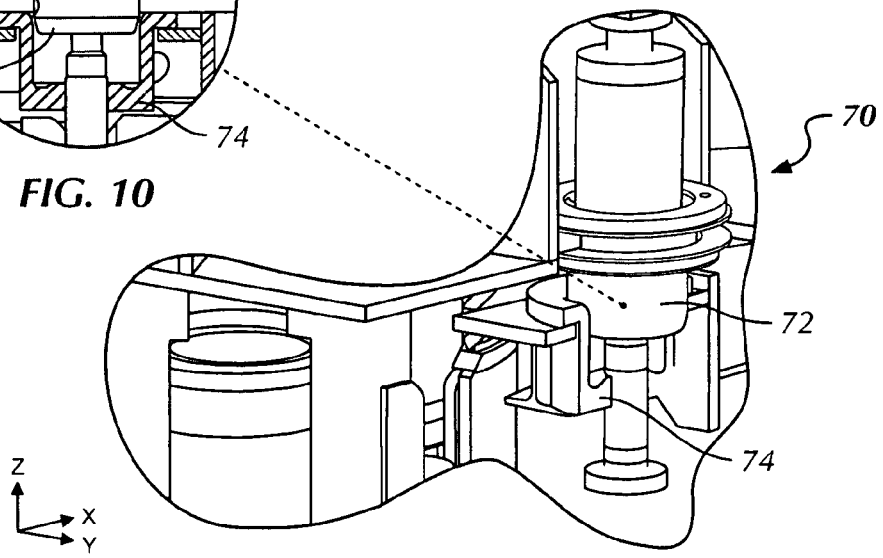
FIG. 9 depicts a more detailed view of a choke and/or kill feed-thru component in accordance with embodiments of the present disclosure.

Referring now to FIGS. 9 and 10, an initial engagement (FIG. 9) and a complete engagement (FIG. 10) of a floating choke line or kill line connection 70 in accordance with embodiments of the present disclosure is shown. Other feed-thru components may have the structure shown in FIGS. 9 and 10. The choke/kill connection 70 includes an alignment body 72 disposed on an LMRP (not shown) and a female bucket 74 disposed on a lower BOP stack assembly (not shown). In other words, the alignment body 72 belongs to a first half of the feed-thru component and the female bucket 74 belongs to a second half of the feed-thru component. The two halves mate together. The initial (physical) engagement (FIG. 9) between a tapered surface 76 of the alignment body 72 and a tapered or radiused region 78 of the female bucket 74 axially aligns the alignment body 72 and the female bucket 74 within a predetermined range. In one embodiment, the alignment body 72 and the female bucket 74 may be initially axially misaligned within about 1.6 mm (about 0.0625 in).

However, the misalignment may be corrected as at least one of the two elements 72 and 74 are allowed to change their positions relative to each other even when the frames of the LMRP and the lower BOP stack are not movable one with respect to another. A final alignment between the alignment body 72 and the female bucket 74 may be achieved when the alignment body 72 enters the female bucket 74.

In an exemplary embodiment, at least one of the two elements 72 and 74 floats to align the two elements to each other while the frames of the LMRP 24 and lower BOP stack 14 are moving relative to each other, i.e., moving closer or away from each other. In other words, the floating of at least one of the halves occurs while the frame of the LMRP 24 is moving towards/away from the frame of the lower BOP stack 14. This aspect is shown in more details in FIGS. 11 and 12. According to another exemplary embodiment, at least one of the elements 72 and 74 floats while the frames of the LMRP 24 and the lower BOP stack 14 are moving and no external pressure from an accumulator is used to move elements 72 and/or 74. For example, the alignment body 72 floats while connecting the female bucket 74 and at the same time the frame of the LMRP 24 is lowered towards the frame of the lower BOP stack 14.

Figure 11:
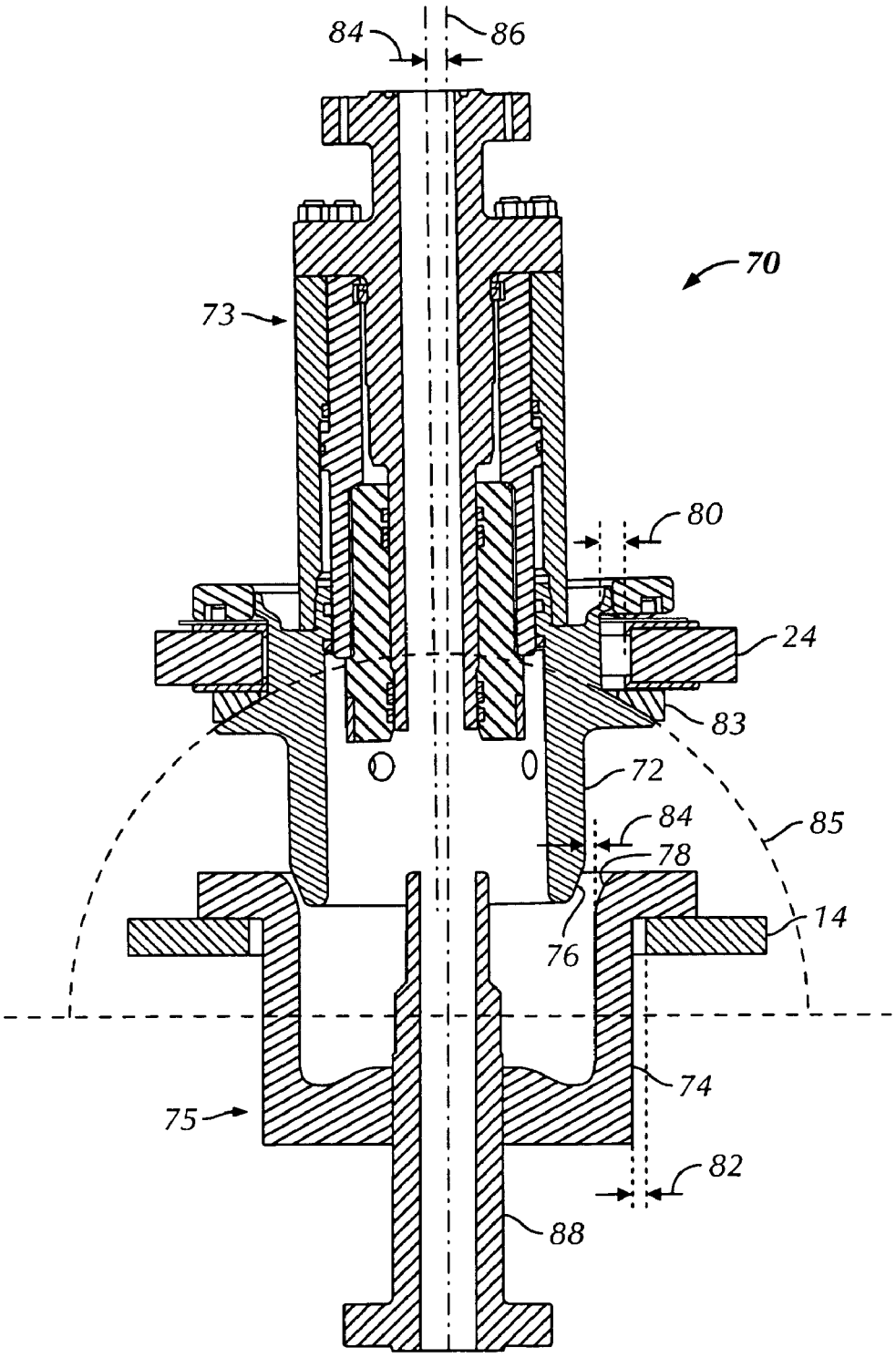
FIG. 11 depicts a cross-sectional view of a choke and/or kill feed-thru component in accordance with embodiments of the present disclosure before hydraulic engagement.

According to another exemplary embodiment, a same element 72 or 74 may be configured to rotate and translate simultaneously. In one application, as shown in FIG. 11, the whole half 73 may move relative to the corresponding frame 24, i.e., all the parts making up the half 73 rotate and/or translate as one element. However, in one application, only certain parts of a half 73 may be configured to move relative to the frame while the other parts of the same half 73 are fixed.

Referring to FIG. 11, a sectioned view of the choke and/or kill connection 70 in initial engagement is shown in more details in accordance with embodiments of the present disclosure. The alignment body 72 may be attached to the LMRP 24 (with an oversized hole tolerance 80), and may be inserted into female bucket 74, which is fixed to the lower BOP stack 14 (with an oversized hole tolerance 82). The oversized hole tolerance 80 may allow the alignment body 72 to move in a plane perpendicular to a longitudinal axis of the well and the oversized hole tolerance 82 may allow the female bucket 74 to move in the same plane, when installed to their respective frames.

In other words, for achieving the mating of the alignment body 72 with the female bucket 74, a hole or recess of the frame of the LMRP 24, in which the alignment body 72 is to be fixed, is made larger by a predetermined amount than a size of the alignment body 72. As already discussed, this predetermined amount is larger that normal tolerances. As would be recognized by one skilled in the art, normal tolerances depend on the size of the frames, the size of the hole, etc. Similar, the hole or recess of the frame of the lower BOP stack 14, to which the female bucket 74 is attached, may be made larger, by a predetermined amount, than a size of the bucket 74. This predetermined amount may be different for each half of the feed-thru components or may be the same for all halves of the feed-thru components. According to another exemplary embodiment, at least one or both of the alignment body 72 and the female bucket 74 may be fixed to its corresponding frame.

After a desired alignment is achieved for the halves within their corresponding holes, one or both halves may be fixed to their frames. This process is performed at the surface, prior to deploying the LMRP 24 and the lower BOP stack 14 undersea. In one application, at least one of the tolerances 80 and 82 are provided and the corresponding element is not fixed to the frame. In another embodiment, both tolerances 80 and 82 are provided and both elements are not fixed to the frame. When mating undersea, the alignment body 72 may be allowed to float within the bucket 74 as shown by gap 84 in FIG. 11, which may be detected as a deviation from an axis 86 of the choke and/or kill connection 70. This floating helps to properly engage the mating components of the choke and/or kill connection 70.

In another exemplary embodiment, a spherical bearing 83 is provided between the frame of the LMRP 24 and the alignment body 72 to allow the alignment body 72 to float within bucket 74 about a spherical path 85. In other words, the first half 73 of the feed-thru component, which includes the alignment body 72, moves relative to the frame of the LMRP 24, i.e., rotates relative to the frame of the LMRP 24. Thus, in one embodiment, a combination of (I) the oversized bucket 74, which provides room for the alignment body 72 to move within, and (II) the spherical bearing 83, which enables a rotation of the alignment body 72, permits the first half 73 of the feed-thru component to float relative to the second half 75 of the feed-thru component. This floating occurs while the frame of the LMRP 24 moves relative to the frame of the lower BOP stack 14. Also, the floating may occur while no pressure (external pressure used to complete the locking of the halves and provided either by accumulators disposed next to the LMRP and/or BOP stack or from the vessel 12) is provided to the LMRP 24 and/or BOP stack 14. Optionally, the alignment body 72 may have a tapered surface 76 and the oversized bucket 74 may have a tapered surface 78 to promote the engagement of elements 72 and 74.

Figure 12:
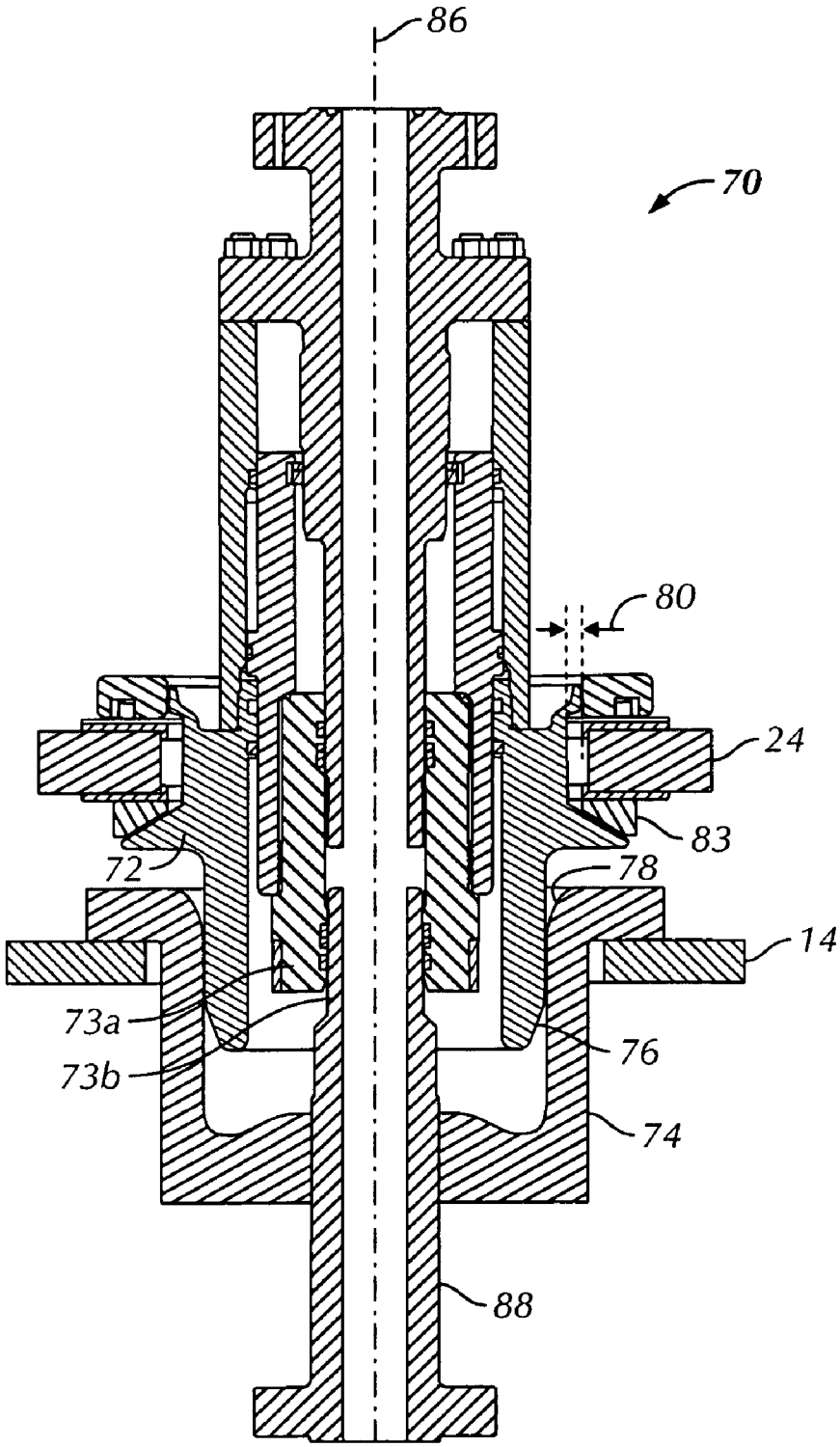
FIG. 12 depicts a cross-sectional view of the choke and/or kill feed-thru component of FIG. 11 after hydraulic engagement.

In one application, the floating of the alignment body 72 takes place while an end of the alignment body 72 is inside the female bucket 74. As shown in FIG. 12, the alignment body 72 may be disposed over a male connector 88 that is fixed to the bucket 74 in alignment, such that the choke and/or kill connection 70 may be engaged. FIG. 12 shows that the LMRP 24 has been lowered towards the lower BOP stack 14 such that an internal pipe 73*a* (choke supplying pipe) of the first half is fully engaged with an internal pipe 73*b* (choke receiving pipe) of the second half, thus achieving the communication link for the choke liquid.

Figure 13:
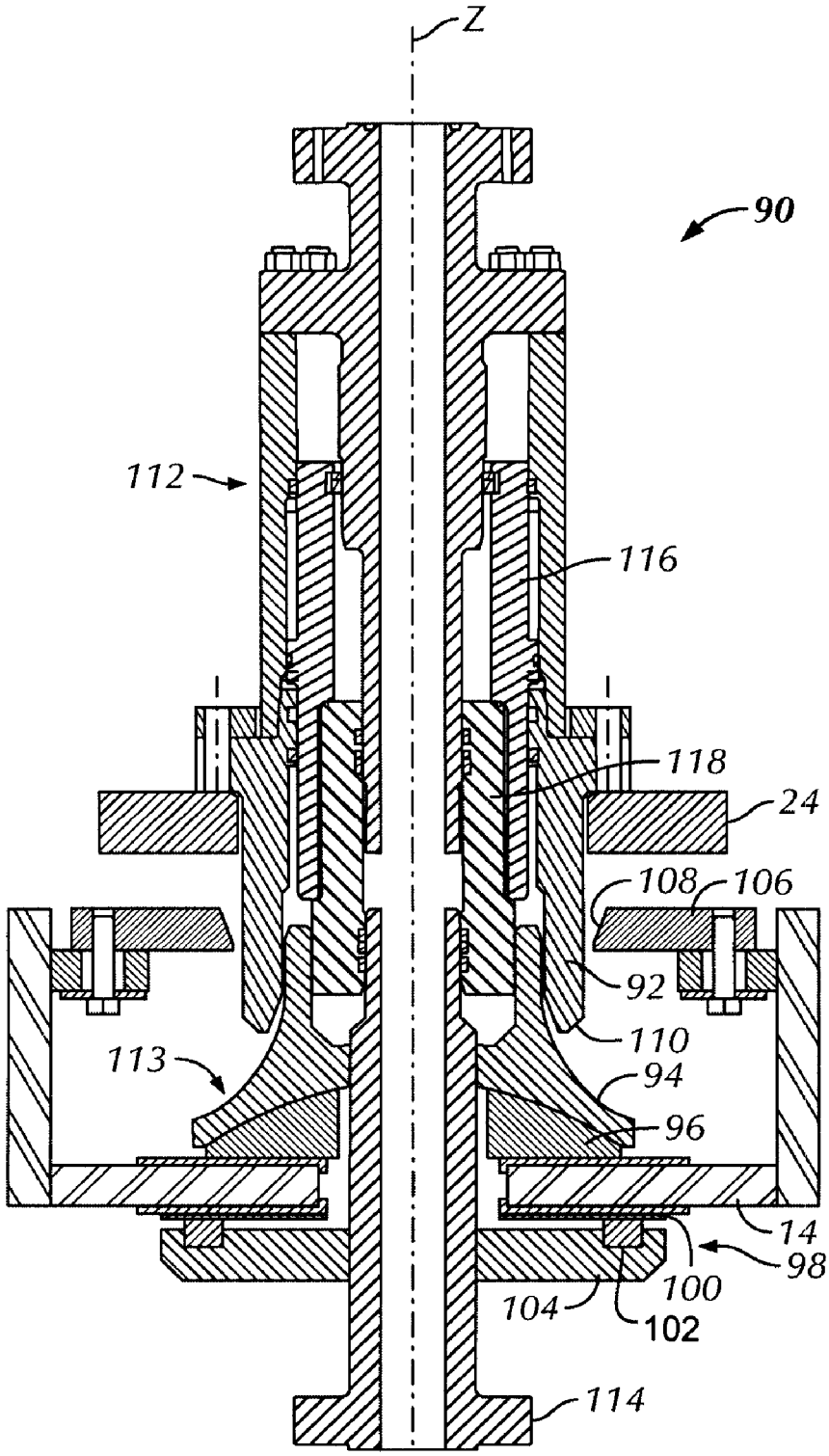
FIG. 13 depicts an alternative embodiment for a choke and/or kill feed-thru component in accordance with embodiments of the present disclosure.

Referring now to FIG. 13, an alternative choke and/or kill connection 90 including a spherical alignment nut 94 is shown. In particular, alignment body 92 may be attached to the LMRP 24 and may interact with lower BOP stack 14 through the spherical alignment nut 94, a spherical wave spring 96, and a thrust bearing 98. Thrust bearing 98 may include a thrust washer 100, a thrust bearing wave spring 102, and a pre-load ring 104. An alignment frame 106 of lower BOP stack 14 may include a taper 108 to centralize and guide tapered surface 110 of alignment body 92 into engagement with alignment nut 94.

Thus, the spherical alignment nut 94, in cooperation with spherical wave spring 96 and thrust bearing 98, allow the "float" in choke and/or kill connection 90 to be performed by the lower mating half (i.e., the mating half attached to lower BOP stack 14). In one application, this "float" is allowed while the frame of the LMRP 24 moves closer to the frame of the lower BOP stack 14. In another application, no external pressure is supplied to piston 116 while still engaging alignment body 92 with the alignment nut 94.

A person having ordinary skill in the art will appreciate that in embodiments disclosed herein, either one or both mating halves of a feed-thru component (e.g., 70, 90) may float with respect to lower BOP stack 14 and LMRP 24. FIG. 13 also shows that alignment frame 106 may move in a plane substantially perpendicular to a longitudinal axis (Z) of the well. In addition, FIG. 13 shows that the configuration of the alignment body 92, when contacting the alignment nut 94, allows the first half 112 of the feed-thru component (the part connected to the LMRP 24) to rotate around a point of contact of the first half 112 with the second half 113 of the feed-thru component (the part connected to the lower BOP stack 14). This rotational motion is similar to a rotational motion that is experienced by a stick having one end free and one end connected to a fixed point.

Once aligned, the first mating half 112 connected to the LMRP 24 may engage the second mating half 113 connected to the lower BOP stack 14 to complete the choke and/or kill feed-thru component between the LMRP 24 and the lower BOP stack 14. Because alignment nut 94 and wave spring 96 include spherical mating surfaces, alignment body 92 is able to float in the X and Y directions in the X-Y plane, as well as with respect to the Z axis (i.e., the alignment body 92 may be slightly angled with respect to the Z axis). After the alignment body 92 and the alignment nut 94 are initially engaged as the frame of the LMRP has been lowered to the lower BOP stack, a piston 116 may be hydraulically actuated to move a lower body 118 downward to engage with male connector 114. Engagement of the lower body 118 with the male connector 114 provides fluid communication between the flow line connector 112 of alignment body 92 and the male connector 114.

Figure 1:
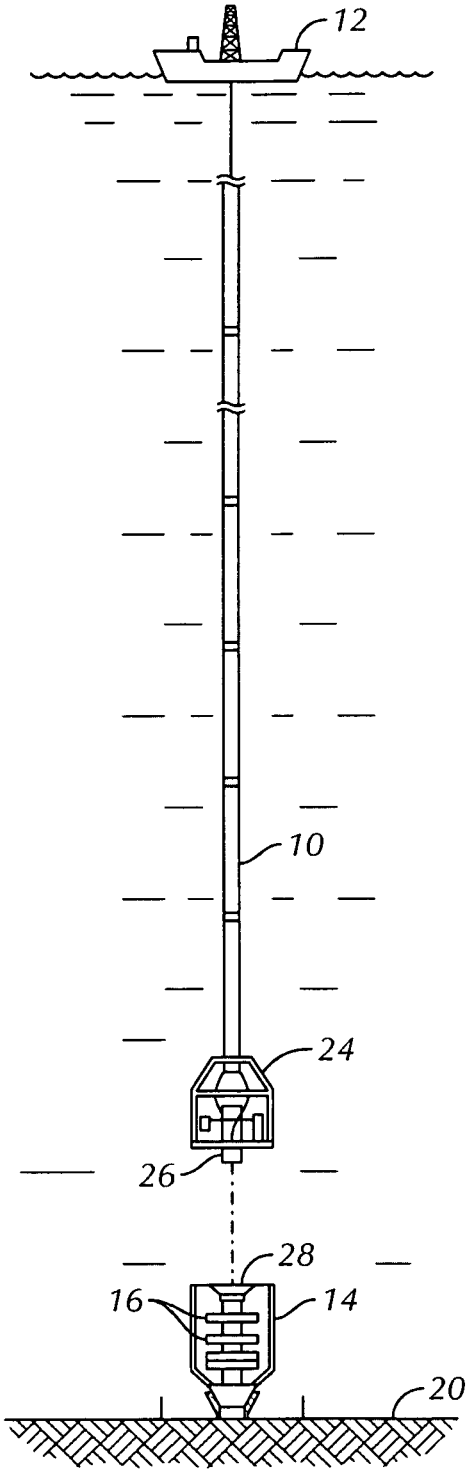
FIG. 1 (Prior Art)
FIG. 1 is a schematic view drawing of a conventional LMRP and a lower BOP stack.
Figure 2:
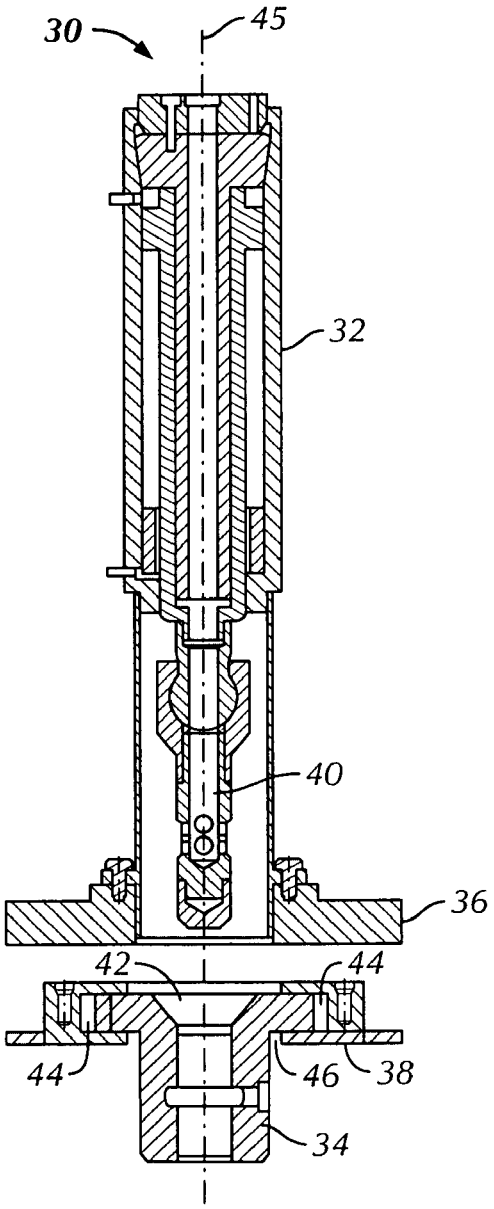
FIG. 2 (Prior Art)
FIG. 2 illustrates a hot stab line prior to being engaged.
Figure 3:
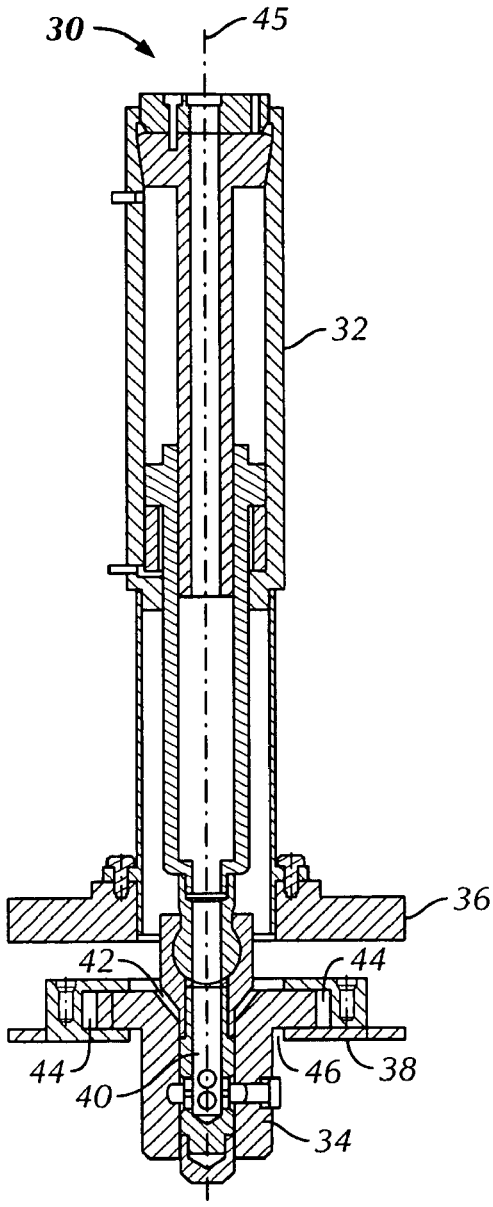
FIG. 3 (Prior Art)
FIG. 3 illustrates the hot stab line of FIG. 2 after being engaged.

In an alternate embodiment, a male connector (e.g., element 114) may be configured to float within alignment nut 94 (or bucket 74 of FIG. 10), which may be fixed to the lower BOP stack 14. In this embodiment, the male connector 114 may be attached to a flexible pipe (e.g., COFLEXIP®, which is an articulated carcass of spiral-wound stainless steel covered by an outer thermoplastic sheath), while the alignment nut 94 is fixed to the LMRP 24. Thus, the male connector 114 may be allowed to float as needed within the fixed alignment nut 94 to properly engage the mating components of the choke and kill connections. This is one example in which only a part 114 of the second half 113 may move relative to its frame. The choke and kill connections are larger and stronger than the hot stab connection discussed with regard to FIGS. 2 and 3. For example, a diameter of the hot stab line connection may be about 1 in (2.54 cm) while a diameter of the kill or choke line connection may be between 2 and 4 in (5 to 10 cm). Also, a pressure provided by the hot stab is around 5,000 (35 kPa) psi while the pressure provided by the choke or kill connections are in the range of 10,000 to 20,000 psi (70 to 140 kPa). In addition, the choke or kill connections may be configured such that a single half of the feed-thru components may rotate and also translate in a given plane at the same time while a corresponding frame is still moving toward the mating frame. Further, the choke or kill connections do not need external pressure for contacting the halves of the feed-thru component.

Figure 14:
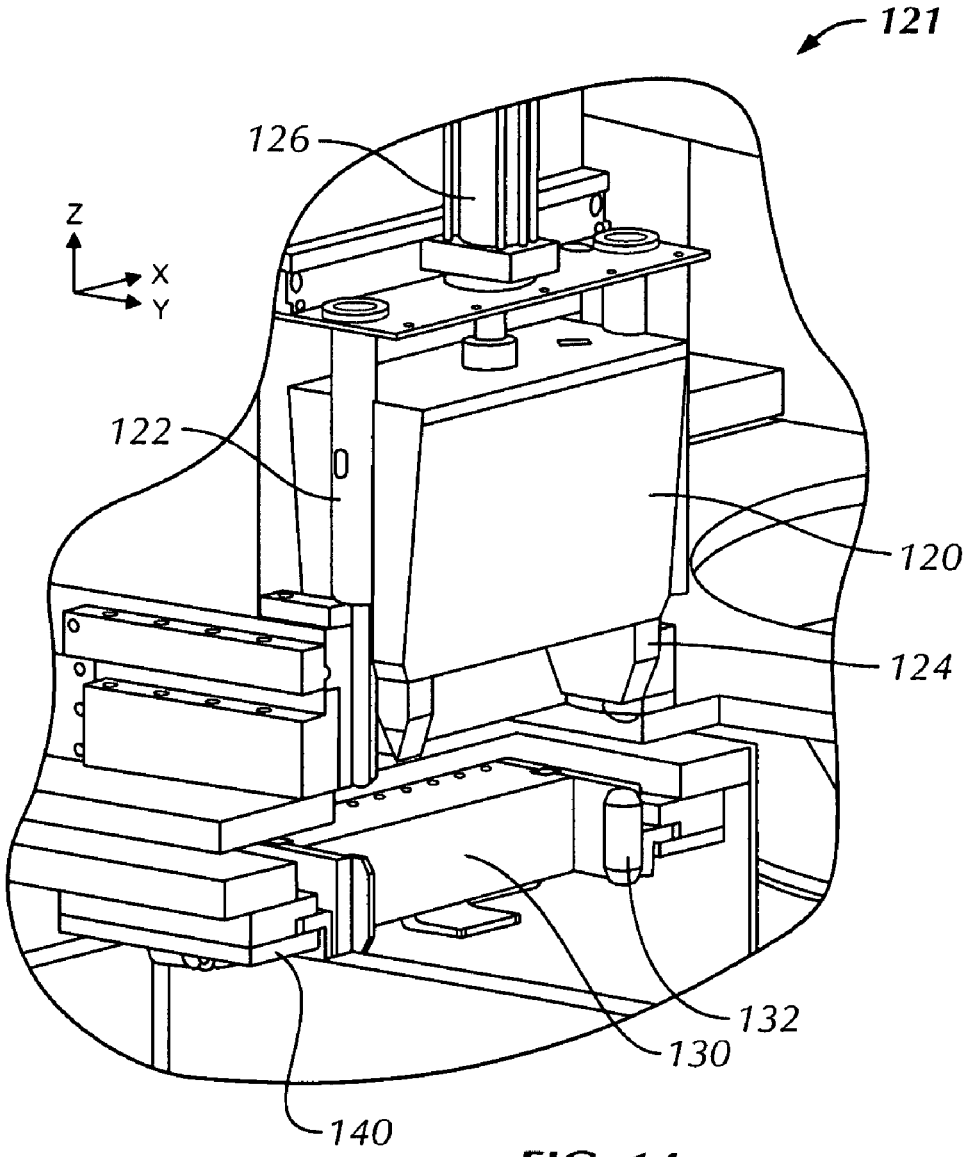
FIG. 14 shows an assembly view of a MUX pod system prior to hydraulic engagement in accordance with embodiments of the present disclosure.
Figure 15:
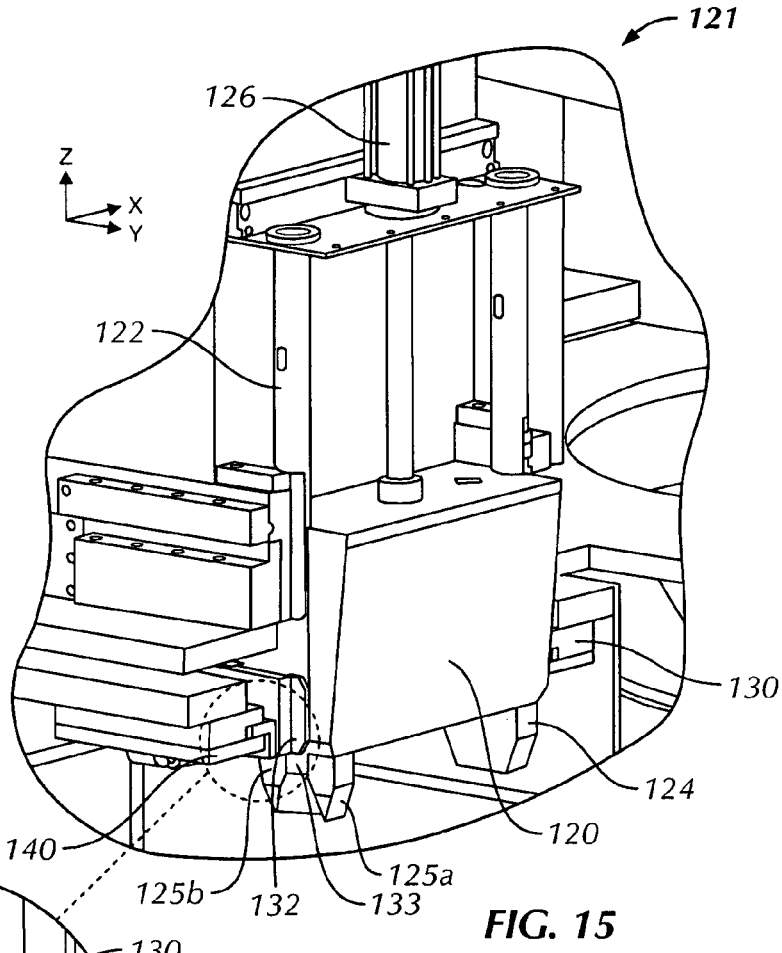
FIG. 15 shows an assembly view of the MUX pod system of FIG. 14 following hydraulic engagement.
Figure 16:
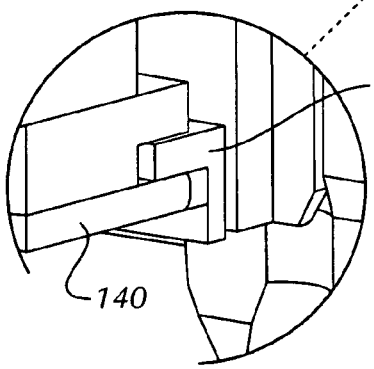
FIG. 16 shows details of the MUX pod system of FIG. 15.

Another feed-thru component that may be present between the LMRP 24 and the lower BOP stack 14 is a MUX pod system, which is shown in FIGS. 14 to 16. A floating MUX pod system 121 in both a retracted position (FIG. 14) and an extended position (FIG. 15) is shown in accordance with embodiments of the present disclosure. The MUX pod system may provide between 50 and 100 different functions to the lower BOP stack and these functions may be initiated and/or controlled from or via the LMRP 24. Thus, a bridge between the LMRP 24 and the lower BOP stack 14 is formed that matches the multiple functions from the LMRP 24 to the lower BOP stack 14. The MUX pod system is used in addition to the choke and kill line connections and may be engaged after the choke and kill lines are engaged.

The floating MUX pod system 121, which is shown in FIG. 14, includes a pod wedge 120 configured to engage a floating receiver 130. The pod wedge 120 has plural holes (not shown), depending on the number of functions provided, that provide various hydraulic and/or electrical signals from the LMRP 24 to the lower BOP stack 14. A hydraulic cylinder 126 may push the pod wedge 120 downward along guide rails 122. As the wedge 120 travels downward, extensions 124 mounted on a bottom face of the pod wedge 120 may contact alignment pins 132 mounted on the floating receiver 130, which causes the floating receiver 130 to align itself with pod wedge 120, as shown in FIG. 15. In one application, the extension 124 may have a groove 125 in which the alignment pin 132 may enter. The groove 125 may have a first section 125*a* that has a width larger that the alignment pin 132 and a second section 125*b*, that has a width smaller than the first section 125*a* but larger than the alignment pin 132. In certain embodiments, receiver 130 merely rests on a support plate 140 with no fasteners, which allows the receiver 130 to float within the boundaries of the support plate 140 as shown in FIG. 16. As described below, the floating receiver 130 may translate or rotate freely, which allows for angular misalignment between the pod wedge 120 and the floating receiver 130 prior to completion of the mating process.

According to an exemplary embodiment, the choke component discussed with regard to FIGS. 11, 12 and 13, the kill component, which may be similar to the choke component, and the MUX component discussed with regard to FIGS. 14 to 16 may be installed on the frames of the LMRPs and lower BOP stacks. As an example, the alignment body 72 (first half) of the choke feed-thru component and the pod wedge 120 (first half) of the MUX feed-thru component may be installed on the frame of the LMRP 24 and the female bucket 74 (second half) of the choke feed-thru component and the receiver 130 (second half) of the MUX feed-thru component may be installed on the frame of the lower BOP stack 14. In one application, when mating the LMRP 24 with the lower BOP stack 14, the halves of both components (choke and MUX, kill component is not discussed here for simplicity) need to be mated. Thus, in one application, all halves connect simultaneously while in another application the halves of a first component connect first followed by the halves of the second component. The same is true when more than two components are used.

In another application, however, one or more pins may be disposed on the frame to engage a corresponding hole on the other frame prior to mating the halves of the components. In still another application, the halves of a feed-thru component are mated and only then the one or more pins and the other halves of the remaining of the feed-thru components are mated. Still according to another exemplary embodiment, a mandrel male may engage first a female connector and then the above noted feed-thru components may be engaged. Such embodiments are discussed later in more details.

Figure 17:
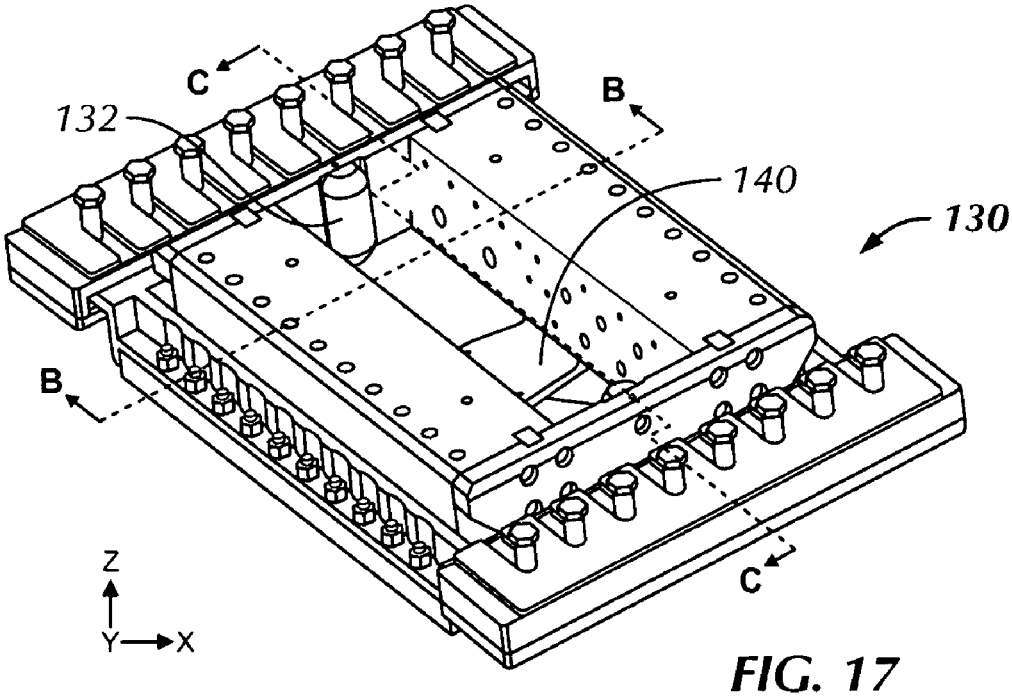
FIG. 17 depicts a perspective view of a floating receiver of a MUX pod system in accordance with embodiments of the present disclosure.
Figure 18:
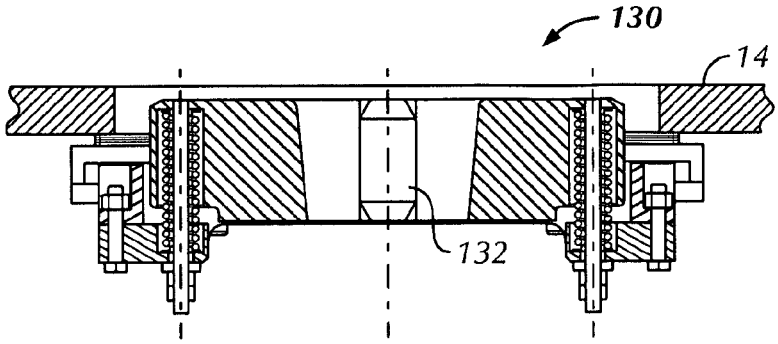
FIG. 18 is a section view drawing of the floating receiver of FIG. 17 taken along section line B-B.
Figure 19:
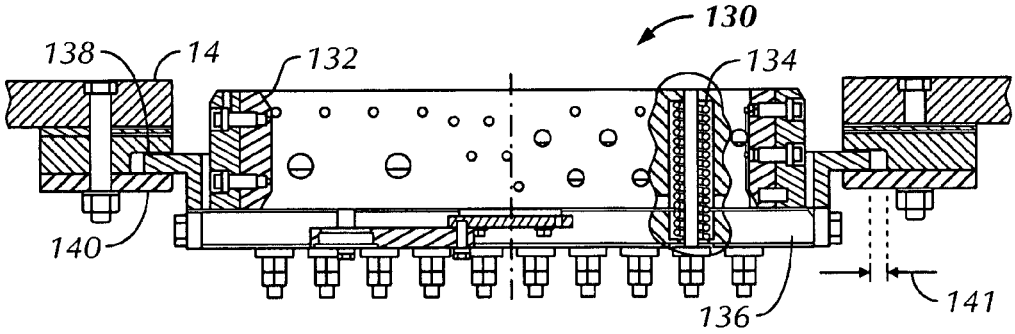
FIG. 19 is a section view drawing of the floating receiver of FIG. 17 taken along section line C-C.

Referring now to FIGS. 17 to 19, a plurality of views of the floating receiver 130 is shown in accordance with embodiments of the present disclosure. FIG. 17 is a perspective view drawing of the floating receiver 130. FIG. 18 is a cross-sectional view of receiver 130 taken along section line B-B of FIG. 17. Similarly, FIG. 19 is a cross-sectional view of floating receiver 130 taken along section line C-C of FIG. 17.

Referring to FIGS. 17 to 19 together, in select embodiments, receiver 130 "floats" on a set of springs 134 that are fastened to a spring frame 136. Spring frame 136 may be held in place between a support block 138 and support plate 140 which may be fastened together, and the spring frame 136 is free to float (by an amount 141) in any direction in the X-Y plane off a centerline as previously mentioned. Further, springs 134 allow receiver 130 to travel or float slightly in a vertical direction (Z direction) and may therefore rotate about the X, Y, and Z axes to compensate for any angular misalignment between the receiver 130 and the pod wedge (120 in FIG. 14).

Figure 20:
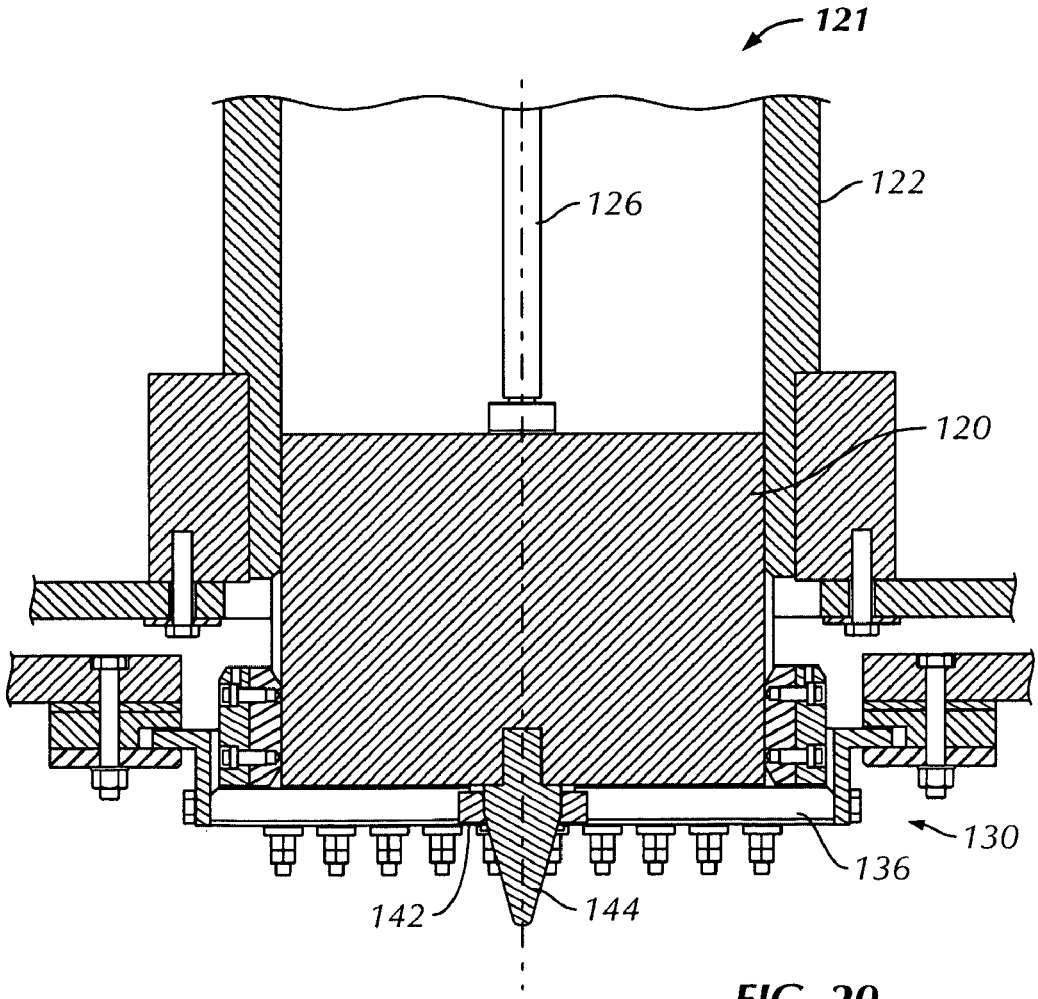
FIG. 20 is a section view drawing of an alternative MUX pod system in accordance with embodiments of the present disclosure.

FIG. 20 shows an alternative embodiment of a MUX pod assembly 121 and a receiver 130 having the receiver plate 136 attached to the bottom thereof. The receiver plate 136 is configured to have an opening 142 that accepts an optional guide pin 144 fixed to the center of the pod wedge 120. When the pod wedge 120 is lowered into place, the guide pin 144 may be inserted in the opening 142 in the receiver plate 136, thus aligning the floating receiver 130 with the pod wedge 120.

Figure 21:
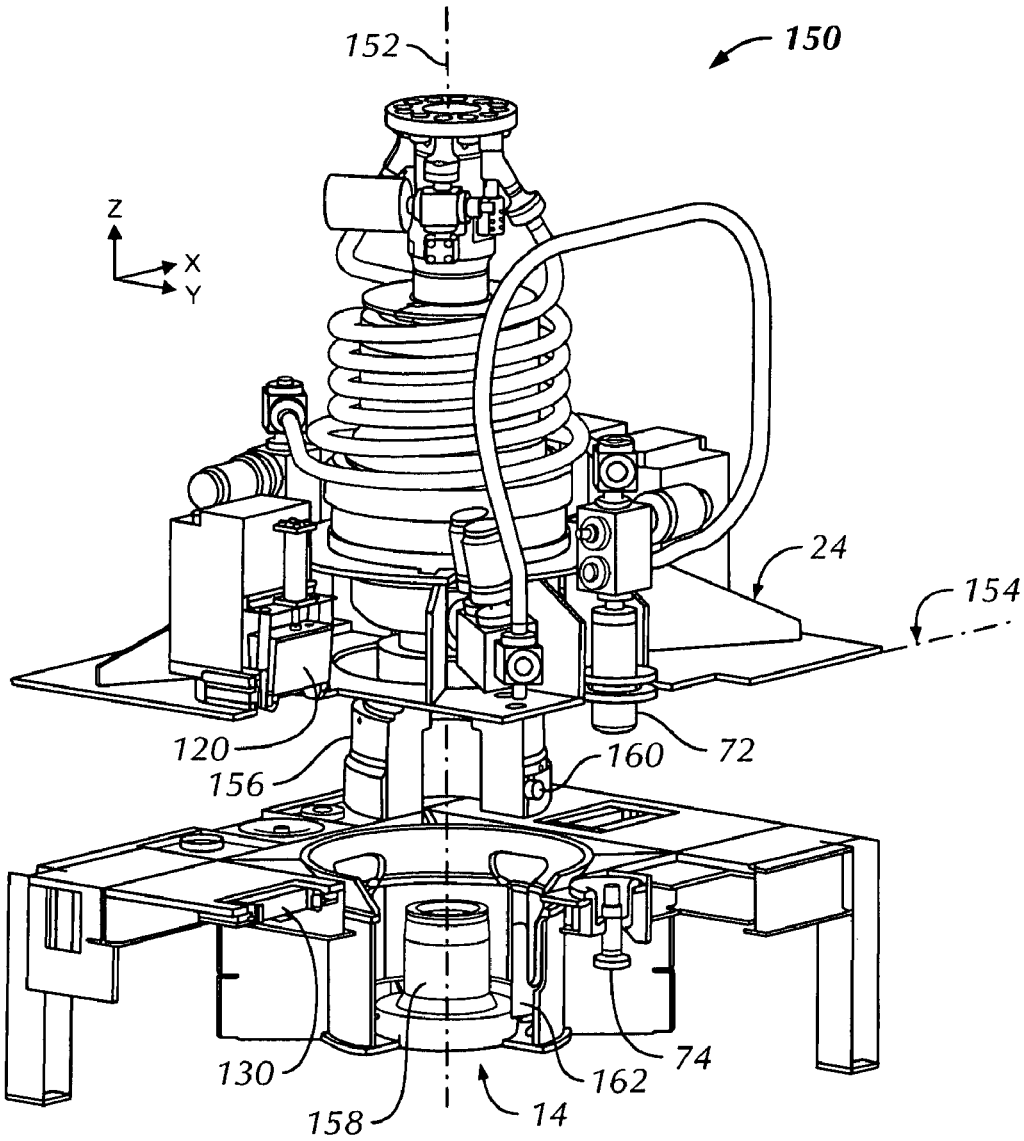
FIG. 21 is an assembly view of a lower marine riser package and a lower BOP stack in accordance with embodiments of the present disclosure.
Figure 22:
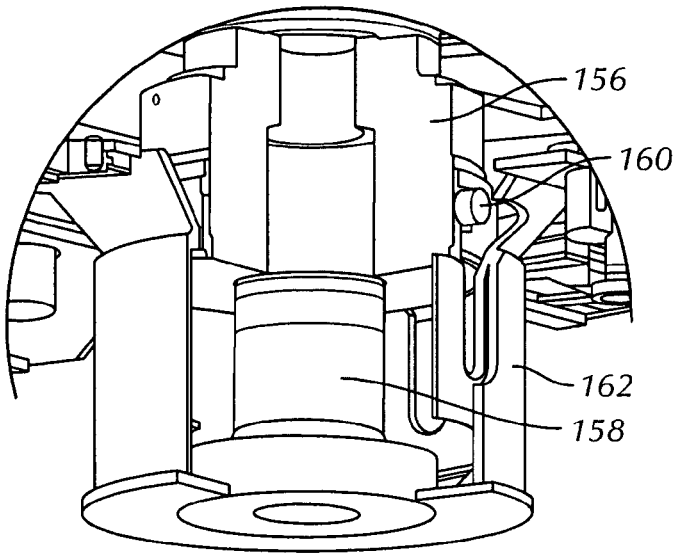
FIG. 22 is an assembly view of a lower marine riser package connector and a mandrel connector in accordance with embodiments of the present disclosure.
Figure 23:
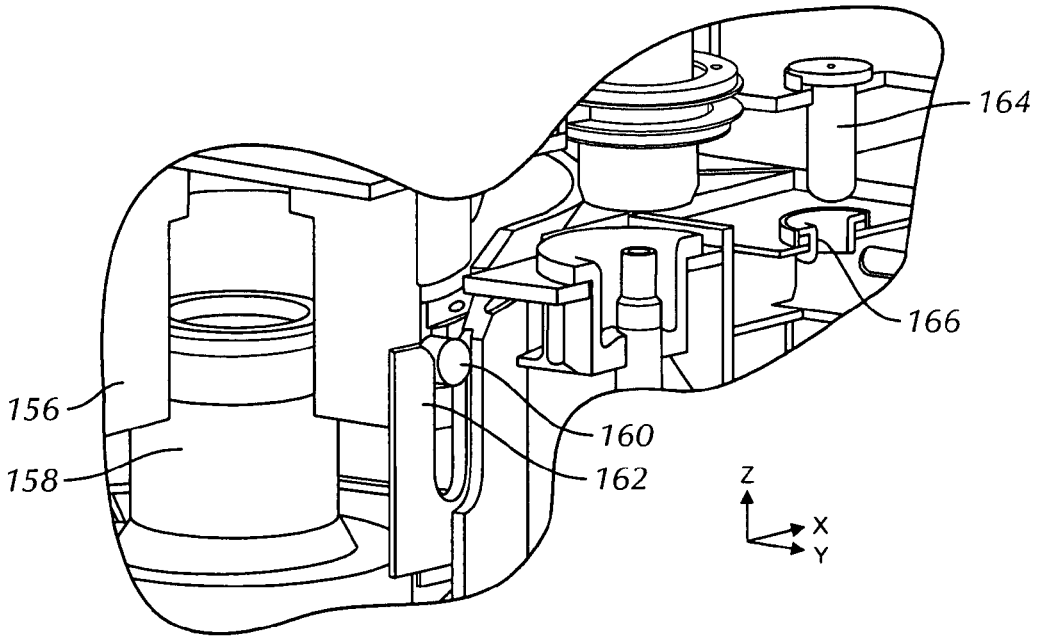
FIG. 23 is an assembly view of a ring alignment pin and an alignment plate in accordance with embodiments of the present disclosure.

As already discussed, in order to properly align the mating components, the LMRP 24 and the lower BOP stack 14 are separately and independently assembled in the manufacturing facility such that the mating halves of the components are in a proper position for engagement. This alignment of the mating halves relative to respective frames is performed using a laser system and/or other alignment systems. Once the LMRP 24 and the lower BOP stack 14 have been manufactured, without dry fitting them in the manufacturing facility, the LMRP 24 and the lower BOP stack 14 are provided to the user. The lower BOP stack 14 is installed on top of a wellhead while the LMRP 24 is attached to the vessel 12 (see for example FIG. 4). Referring to FIGS. 21-23, various stages of subsea assembly between the LMRP 24 and the lower BOP stack 14 into a wellhead stack assembly 150 are shown in accordance with embodiments of the present disclosure.

The LMRP 24 and the lower BOP stack 14 may be axially aligned about vertical datum axis 152 and may be horizontally (or angularly) aligned based on horizontal datum axis 154. In one application, a female LMRP connector 156 of LMRP assembly 24 may initially contact a corresponding male mandrel connector 158 of lower BOP stack 14 as shown in FIG. 21. The engagement between LMRP connector 156 and mandrel connector 158 aligns LMRP 24 and lower BOP stack 14 axially (about central axis 152) with each other.

FIG. 21 also shows the choke component (halves 72 and 74) discussed with regard to FIGS. 11, 12 and 13 and the MUX component (halves 120 and 130) discussed with regard to FIGS. 14-20. Other components, as the kill component, may be present but are not shown. The halves of the choke and MUX components may individually have the features shown in FIGS. 11 to 20, i.e., each half may have the "floating" capability independent of the other halves. However, in one embodiment, some of the halves have the "floating" capability while others are fixed to the frames. Although only the choke and MUX components are labeled in FIG. 21, other components may be added to the LMRP 24 and lower BOP stack 14.

To rotationally align the stack assemblies, edges of the LMRP 24 may be aligned with edges of the lower BOP stack 14, provided each of the frames of the LMRP 24 and lower BOP stack 14 has the same arrangement 50 positioned relative to these edges (a same "footprint"). Alternatively, even if the LMRP 24 and BOP stack 14 do not have the same footprint, one or more pins and corresponding holes may be used to align the LMRP 24 and the lower BOP stack 14. Rotational alignment of the LMRP 24 and lower BOP stack 14 ensures that the previously clocked component pattern layouts are aligned properly and allowed to engage. Optionally, rotational alignment between the LMRP 24 and the lower BOP stack 14 may be accomplished using a "key" and "groove" configuration in the LMRP 24 and the lower BOP stack 14.

Referring to FIG. 22, an example of a key is an alignment ring pin 160 and an example of a groove is an alignment plate 162. The alignment ring pin 160 of LMRP 24 may engage with an alignment plate 162 of lower BOP stack 14 as shown. The engagement between alignment ring pin 160 and alignment plate 162 may rotationally restrict the LMRP 24 and the lower BOP stack 14 within a predetermined range. In one embodiment, the alignment ring pin 160 and alignment plate 162 may rotationally restrict the LMRP 24 and the lower BOP stack 14 within approximately 0.5 degrees (about the Z axis which corresponds to vertical datum axis 152 shown in FIG. 21).

This restriction or "pre-alignment" may provide alignment of additional mating components that are to be engaged subsequently during assembly (e.g., choke and/or kill feed-thru components, MUX pod feed-thru components). In other words, after the engagement of the alignment ring pin 160 and the alignment plate 162, further alignment of the feed-thru components is still possible as one or more halves of the feed-thru components maintain the ability to rotate/translate (i.e., float) relative to its corresponding half. Thus, although the movement of the LMRP 24 is restricted by the assembly 160 and 162 relative to the lower BOP stack 14, the movement of the halves of the feed-thru components is not and also a linear movement of the LMRP 24 towards the lower BOP stack 14 is not impaired by the assembly 160 and 162.

Figure 24:
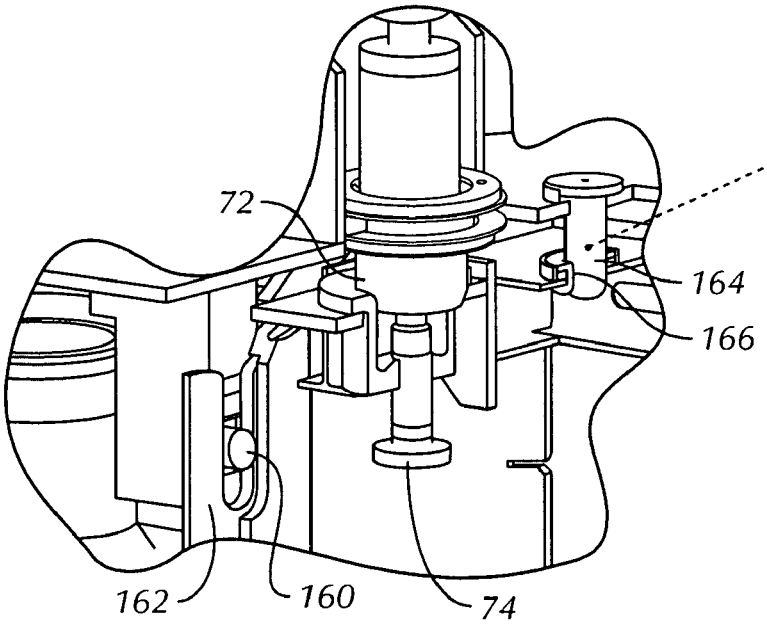
FIG. 24 is an assembly view of a final alignment pin and a final alignment pin receiver in accordance with embodiments of the present disclosure.
Figure 25:
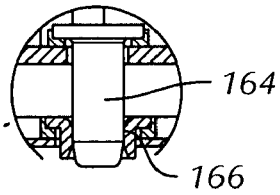
FIG. 25 is a cross-sectional view of the final alignment pin and receiver of FIG. 24.

Referring now to FIG. 23, in an alternative embodiment, pre-alignment of the alignment ring pin 160 with alignment plate 162 may pre-align a final alignment pin 164 and a final alignment pin receiver 166 (that may be constructed having a tighter tolerance than ring pin 160 and alignment plate 162) before engagement during assembly, as described in more detail below. Optional final alignment pin 164 is shown engaged with a final alignment pin receiver 166 in accordance with certain embodiments of the present disclosure in FIGS. 24 and 25. While a final alignment pin 164 and pin receiver 166 are shown, one of ordinary skill in the art will understand that a final alignment pin 164 and pin receiver 166 (in addition to ring pin 160 and alignment plate 162 of FIG. 23 described above) are optional and therefore not required in any embodiments of the present disclosure. Therefore, various embodiments disclosed herein may optionally include or not include such alignment structures. In embodiments lacking ring pin 160 and/or final alignment pin 164, LMRP 24 may be "landed" to lower BOP stack 14 using external devices or structures. For example a GPS-equipped ROV may precisely guide LMRP 24 to its mating position atop lower BOP stack 14. Furthermore, an external frame structure may be constructed to receive and align LMRP 24 in route to engagement and make-up with lower BOP stack 14. More than two pins 160 and 164 may be used for the final engagement of the LMRP 24 and BOP stack 14.

In one exemplary embodiment, any order of engagement for the pairs (160, 162), (120, 130), (72, 74), (164, 166), etc. may be used. As an example only, the following order may be used when mating the LMRP 24 and the lower BOP stack 14: first, pair (160, 162) followed by choke component (72, 74), followed by MUX component (120, 130), followed by other components, followed, finally, by pair (164, 166). Other sequences, depending on the functionalities and the structure of the LMRP and BOP stack, may be used as would be appreciated by those skilled in the art.

To complete the assembly, LMRP connector 156 may "bottom out" on mandrel connector 158, after which LMRP connector 156 may then be hydraulically engaged and locked to mandrel connector 158 with a hydraulic system. LMRP 24 and the lower BOP stack 14 are considered to be fully engaged at this stage; however the lower BOP stack 14 is not fully functional until mating components such as the MUX pod wedge 120 and receiver 131 and the choke and/or kill feed-thru components 70 are hydraulically engaged.

After fully engaging the corresponding mating components (i.e., hydraulic engagement of, for example, choke and/or kill lines and MUX pod system) the LMRP 24 and the lower BOP stack 14 may be in communication with each other and may be considered fully functional. In the event that the LMRP 24 and the lower BOP stack 14 need to be separated, the corresponding mating halves of the feed-thru components may first be hydraulically (or electrically or mechanically) disengaged and prepared for separation, followed by separation of the LMRP 24 from the lower BOP stack 14. Further, if the need arises, either the LMRP 24 or the lower BOP stack 14 may be removed and replaced with another interchangeable LMRP or lower BOP stack, of which the assembly will follow the procedure as outlined above.

Figure 26:
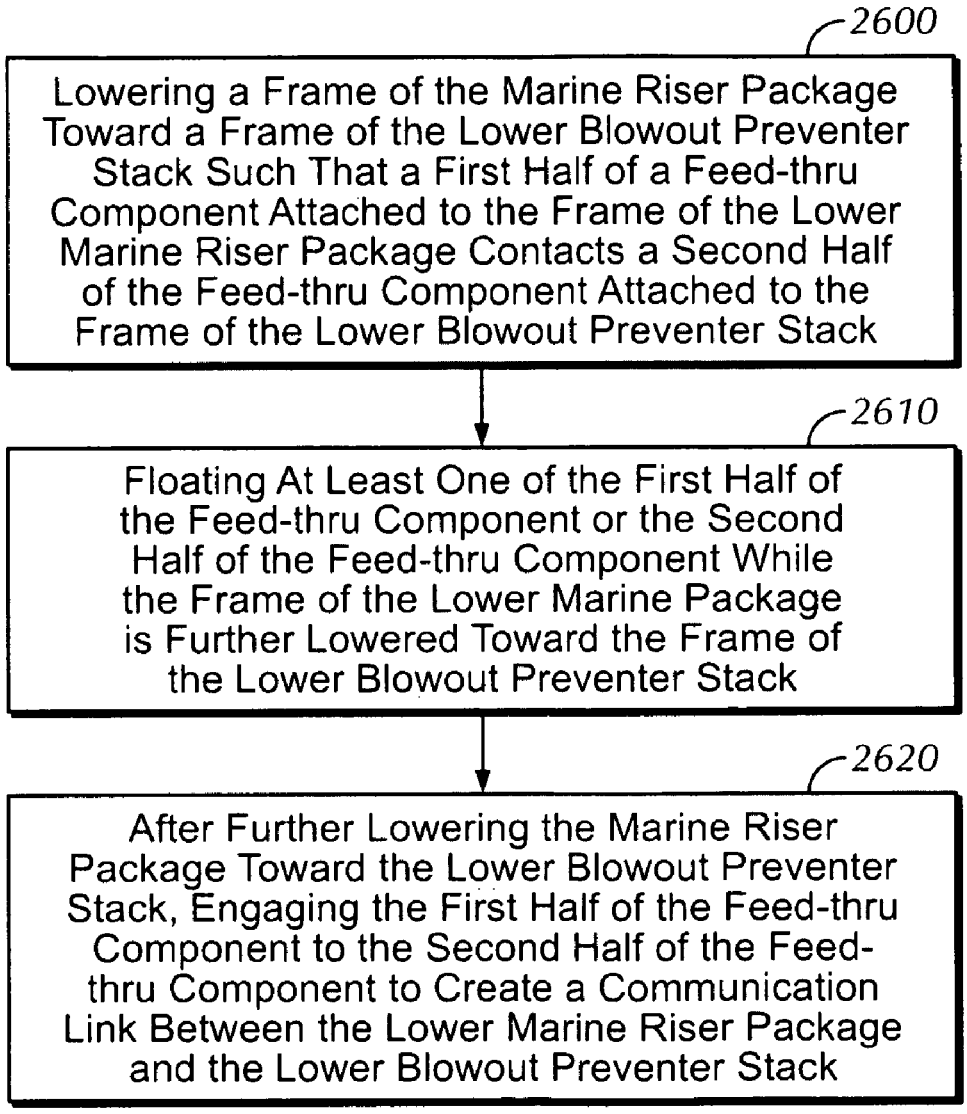
FIG. 26 is a flow chart illustrating steps of a method for connecting a lower marine riser package to a lower blowout preventer stack.

Therefore, according to an exemplary embodiment, steps of a method for connecting a lower marine riser package to a lower blowout preventer stack are illustrated in FIG. 26. The method includes a step 2600 of lowering a frame of the lower marine riser package toward a frame of the lower blowout preventer stack such that a first half of a feed-thru component attached to the frame of the lower marine riser package contacts a second half of the feed-thru component attached to the frame of the lower blowout preventer stack. The method further includes a step 2610 of floating at least one of the first half of the feed-thru component or the second half of the feed-thru component while the frame of the lower marine package is further lowered toward the frame of the lower blowout preventer stack, wherein floating comprises allowing a part of the first half of the feed-thru component to move with respect to the frame of the lower marine riser package or allowing a part of the second half of the feed-thru component to move with respect to the frame of the lower blowout preventer stack. The method furthermore includes a step 2620 of engaging, after further lowering the lower marine riser package toward the lower blowout preventer stack, the first half of the feed-thru component to the second half of the feed-thru component to create a communication link between the lower marine riser package and the lower blowout preventer stack.

Advantageously, embodiments of the present disclosure may provide an interchangeable wellhead stack of which the LMRP and the lower BOP stack may each be manufactured separately and then assembled without a requirement that the LMRP and lower BOP stack first be assembled or test/dry fit for adjustments. By producing a repeatable component layout that may then be applied to the frames for manufacture of the components on the frames, the need to test/dry fit the LMRP and lower BOP stack before assembly may be eliminated. Additionally, the feed-thru component pattern may allow for mass production of the stack assemblies. The ability to mass produce such assemblies may further lead to increased productivity of the assemblies and/or efficiency of manufacturing the assemblies. The increased efficiency of mass producing the interchangeable LMRP and lower BOP stack assemblies may lead to decreased production costs. Further, interchangeable LMRP and lower BOP stack assemblies may provide fewer occurrences of misfits, which may reduce costly rig downtime and the number of trips to and from the surface when installing the assemblies.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments. Finally, in the claims, any means-plus-function clause is intended to cover the structures described herein as performing the recited function and not only structural equivalents, but also equivalent structures.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

What is claimed is:

1. A method for connecting a lower marine riser package to a lower blowout preventer stack, the method comprising:

lowering a frame of the lower marine riser package toward a frame of the lower blowout preventer stack such that a first half of a feed-thru component attached to the frame of the lower marine riser package contacts a second half of the feed-thru component attached to the frame of the lower blowout preventer stack;

floating at least one of the first half of the feed-thru component or the second half of the feed-thru component while the frame of the lower marine package is further lowered toward the frame of the lower blowout preventer stack, wherein floating comprises allowing a part of the first half of the feed-thru component to move with respect to the frame of the lower marine riser package or allowing a part of the second half of the feed-thru component to move with respect to the frame of the lower blowout preventer stack; and after further lowering the lower marine riser package toward the lower blowout preventer stack, engaging the first half of the feed-thru component to the second half of the feed-thru component to create a communication link between the lower marine riser package and the lower blowout preventer stack, wherein engaging the first half with the second half is achieved without using an external pressure provided by an accumulator.

2. The method of claim 1, further comprising:

locking the first half to the second half by actuating a piston of the first or second half with the external pressure, the locking achieving a functionality of the communication link.

3. The method of claim 1, further comprising:

floating the part of the first half of the feed-thru component within a corresponding part of the second half of the feed-thru component.

4. The method of claim 1, wherein floating comprises allowing the entire first half of the feed-thru component to move with respect to the frame of the lower marine riser package.

5. The method of claim 1, wherein floating comprises allowing the entire second half of the feed-thru component to move with respect to the frame of the lower blowout preventer stack.

6. The method of claim 1, wherein the feed-thru component comprises at least one of a choke line, a kill line, a multiplex hydraulic pod connection, a hydraulic feed-thru connector, or an electrical feed-thru connector.

7. The method of claim 1, wherein the move during the floating comprises:

allowing at least one of the first half or second half of the feed-thru component to translate in an oversized hole formed in a corresponding frame while the frame of the lower marine riser package is further lowered toward the frame of the lower blowout preventer stack, the oversized hole extending in a plane substantially perpendicular to a longitudinal axis of a well to which the lower blowout preventer stack is attached.

8. The method of claim 1, wherein the move during the floating comprises:

allowing at least one of the first or second half of the feed-thru component to rotate about a point of contact between the first half of the feed-thru component and the second half of the feed-thru component or allowing at least one of the first or second half to rotate relative to a corresponding frame while the frame of the lower marine riser package is further lowered toward the frame of the lower blowout preventer stack.

9. The method of claim 1, further comprising:

connecting at least a pin of the lower marine riser package to a hole of the lower blowout preventer stack or connecting at least a pin of the lower blowout preventer stack to a hole of the lower marine riser package.

10. A lower marine riser package, comprising:

a frame having a mating surface; and a first half of a feed-thru component configured to mate with a second half of the feed-thru component, the first half being displaced in a hole of the frame, wherein the mating surface of the frame is configured to be lowered toward a proximal end of a lower blowout preventer stack such that the first half of the feed-thru component contacts the second half of the feed-thru component, the second half being attached to a frame of the lower blowout preventer stack, the first half is configured to float as the frame of the lower marine riser package is lowered further toward the proximal end of the lower blowout preventer stack, wherein floating comprises allowing a part of the first half of the feed-thru component to move with respect to the frame of the lower marine riser package, and the first half is configured to engage, after further lowering the frame of the lower marine riser package toward the lower blowout preventer stack, with the second half of the feed-thru component to create a communication link between the lower marine riser package and the lower blowout preventer stack, wherein engaging the first half with the second half is achieved without using an external pressure provided by an accumulator.

11. The lower marine riser package of claim 10, wherein the first half protrudes outwardly from the mating surface of the frame of the lower marine riser surface while the frame is lowered toward the lower blowout preventer stack.

12. The lower marine riser package of claim 10, wherein the first half is configured to lock with the second half by using the external pressure provided to the lower marine riser package by the accumulator.

13. The lower marine riser package of claim 10, wherein the entire first half of the feed-thru component is configured to move with respect to the frame of the lower marine riser package.

14. The lower marine riser package of claim 10, wherein the move of the part of the first half of the feed-thru component includes at least one of:

translating the part of the first half in an oversized hole formed in the frame of the lower marine riser package while the frame is further lowered toward the lower blowout preventer stack, the oversized hole extending in a plane substantially perpendicular to a longitudinal axis of a well to which the lower blowout preventer stack is attached, or rotating the part of the first half about a point of contact between the first half of the feed-thru component and the second half of the feed-thru component or allowing the first half to rotate relative to the frame of the lower marine riser package.

15. The lower marine riser package of claim 10, wherein the feed-thru component comprises at least one of a choke line, a kill line, a multiplex hydraulic pod connection, a hydraulic feed-thru connector, a hot stab line, or an electrical feed-thru connector.

16. A lower blowout preventer stack, comprising:

a frame having a mating surface; and a first half of a feed-thru component configured to mate with a second half of the feed-thru component, the first half being displaced in a hole of the frame, wherein the mating surface of the frame is fixed and the second half is lowered toward the first half such that the first half of the feed-thru component contacts the second half of the feed-thru component, the second half being attached to a frame of a lower marine riser package, the first half is configured to float as the frame of the lower marine riser package is lowered further toward the frame of the lower blowout preventer stack, wherein floating comprises allowing a part of the first half of the feed-thru component to move with respect to the frame of the lower blowout preventer stack, and the first half is configured to engage, after further lowering the frame of the lower marine riser package, with the second half of the feed-thru component to create a communication link between the lower marine riser package and the lower blowout preventer stack, wherein engaging the first half with the second half is achieved without using an external pressure provided by an accumulator.

17. The lower blowout preventer stack of claim 16, wherein the first half is configured to lock with the second half by using the external pressure provided by the accumulator.

18. The lower blowout preventer stack of claim 16, wherein the entire first half of the feed-thru component is configured to move with respect to the frame of the lower blowout preventer stack.

19. The lower blowout preventer stack of claim 16, wherein the move of the part of the first half of the feed-thru component includes at least one of:

translating the part of the first half in an oversized hole formed in the frame of the lower blowout preventer stack while the frame of the lower marine riser package is lowered toward the lower blowout preventer stack, the oversized hole extending in a plane substantially perpendicular to a longitudinal axis of a well to which the lower blowout preventer stack is attached, or rotating the part of the first half about a point of contact between the first half of the feed-thru component and the second half of the feed-thru component, or allowing the first half to rotate relative to the frame of the lower blowout preventer stack.

20. The lower blowout preventer stack of claim 16, wherein the feed-thru component comprises at least one of a choke line, a kill line, a multiplex hydraulic pod connection, a hydraulic feed-thru connector, a hot stab line, or an electrical feed-thru connector.

* * * * *